US012326080B2

(12) United States Patent
Thompson et al.

(10) Patent No.: US 12,326,080 B2
(45) Date of Patent: Jun. 10, 2025

(54) METHOD AND APPARATUS FOR MEASURING A WELLBORE

(71) Applicant: GEONOMIC TECHNOLOGIES INC., Calgary (CA)

(72) Inventors: Christopher S. Thompson, Calgary (CA); David A. Switzer, Conroe, TX (US); Rodney M. Wingerter, Conroe, TX (US); Jawad A. Alsadah, Katy, TX (US)

(73) Assignee: GEONOMIC TECHNOLOGIES INC., Calgary (CA)

( * ) Notice: Subject to any disclaimer, the term of this patent is extended or adjusted under 35 U.S.C. 154(b) by 0 days.

(21) Appl. No.: 18/411,411

(22) Filed: Jan. 12, 2024

(65) Prior Publication Data

US 2024/0151135 A1 May 9, 2024

Related U.S. Application Data

(63) Continuation of application No. 17/942,337, filed on Sep. 12, 2022, now Pat. No. 12,000,266, which is a (Continued)

(51) Int. Cl.
*E21B 17/22* (2006.01)
*E21B 47/08* (2012.01)

(52) U.S. Cl.
CPC ..... *E21B 47/08* (2013.01)

(58) Field of Classification Search
CPC ..... E21B 17/22; E21B 17/1078
See application file for complete search history.

(56) References Cited

U.S. PATENT DOCUMENTS 2,267,110 A 12/1941 Kinley et al.
2,638,988 A 5/1953 Williams
(Continued)

FOREIGN PATENT DOCUMENTS

AU 2011227425 B2 8/2016
CA 2215888 C 8/2001
(Continued)

OTHER PUBLICATIONS

International Search Report issued in connection with Patent Cooperation Treaty Patent Application Serial No. PCT/CA2024/050043 completed on Mar. 21, 2024 and mailed Apr. 11, 2024.
(Continued)

*Primary Examiner* — Kenneth L Thompson
(74) *Attorney, Agent, or Firm* — Oyen Wiggs Green & Mutala LLP; Nicholas Garner

(57) ABSTRACT

There is provided a wellbore measuring apparatus according to one aspect. The wellbore measuring apparatus includes an outer body that is tubular with spaced-apart ends threaded for connection in line with a drill string. The outer body has a plurality of recesses extending around the outer surface thereof in one or more helical patterns. The wellbore measuring apparatus includes a plurality of sensors operatively coupled to and each positioned within a respective said recess of the outer body. Each sensor is arranged to measure at least one characteristic of a wellbore. The wellbore measuring apparatus may include at least one rib coupled to and extending radially outwards from the outer surface of the outer body. The at least one rib is helical in shape and with the plurality of sensors extending along and being adjacent to the at least one rib.

20 Claims, 11 Drawing Sheets

Related U.S. Application Data continuation of application No. PCT/CA2021/050337, filed on Mar. 12, 2021.

(60) Provisional application No. 62/989,420, filed on Mar. 13, 2020.

(56) References Cited

U.S. PATENT DOCUMENTS

| | | | | |
|---|---|---|---|---|
| 2,712,697 | A | 7/1955 | Lebourg | |
| 2,854,758 | A | 10/1958 | Owen | |
| 2,933,819 | A | 4/1960 | Kinley | |
| 3,010,212 | A | 11/1961 | Kinley | |
| 3,023,507 | A | 3/1962 | Camp | |
| 3,097,433 | A | 7/1963 | Cubberly, Jr. | |
| 3,183,600 | A | 5/1965 | Jay | |
| 3,348,314 | A | 10/1967 | Venghiattis | |
| 3,474,541 | A | 10/1969 | Cubberly, Jr. | |
| 3,800,277 | A | 3/1974 | Harrell et al. | |
| 4,251,921 | A | 2/1981 | Fink | |
| 4,299,033 | A | 11/1981 | Kinley et al. | |
| 4,320,579 | A | 3/1982 | Kinley et al. | |
| 4,407,157 | A | 10/1983 | Lichtenberg | |
| 4,559,709 | A | 12/1985 | Beseme et al. | |
| 4,571,848 | A | 2/1986 | Krutz et al. | |
| 4,673,890 | A | 6/1987 | Copland et al. | |
| 4,692,908 | A | 9/1987 | Ekstrom et al. | |
| 4,862,090 | A | 8/1989 | Vannier et al. | |
| 4,928,758 | A | 5/1990 | Siegfried, II | |
| 5,101,104 | A | 3/1992 | Schroeder | |
| 5,242,020 | A | 9/1993 | Cobern | |
| 5,243,562 | A | 9/1993 | Laurent et al. | |
| 5,255,245 | A | 10/1993 | Clot | |
| 5,341,345 | A | 8/1994 | Warner et al. | |
| 5,353,873 | A | 10/1994 | Cooke, Jr. | |
| 5,430,259 | A | 7/1995 | Warner | |
| 5,469,736 | A | 11/1995 | Moake | |
| 5,513,528 | A | 5/1996 | Holenka et al. | |
| 5,801,642 | A | 9/1998 | Meynier | |
| 6,339,886 | B1 | 1/2002 | Reinhardt | |
| 6,560,889 | B1 | 5/2003 | Lechen | |
| 6,580,449 | B1 | 6/2003 | Meltzer | |
| 6,585,044 | B2 * | 7/2003 | Rester | E21B 49/087 166/250.01 |
| 6,611,761 | B2 | 8/2003 | Sinha et al. | |
| 6,618,322 | B1 | 9/2003 | Georgi | |
| 6,661,737 | B2 | 12/2003 | Wisniewski et al. | |
| 6,847,304 | B1 | 1/2005 | McLoughlin | |
| 6,942,043 | B2 * | 9/2005 | Kurkoski | E21B 47/01 175/45 |
| 7,036,363 | B2 | 5/2006 | Yogeswaren | |
| 7,069,775 | B2 | 7/2006 | Fredette et al. | |
| 7,107,154 | B2 | 9/2006 | Ward | |
| 7,281,578 | B2 | 10/2007 | Nakajima et al. | |
| 7,389,828 | B2 | 6/2008 | Ritter et al. | |
| 7,669,668 | B2 | 3/2010 | Martinez et al. | |
| 7,698,937 | B2 | 4/2010 | Neidhardt | |
| 7,828,066 | B2 | 11/2010 | Jahn | |
| 7,967,081 | B2 | 6/2011 | Sugiura et al. | |
| 8,024,868 | B2 | 9/2011 | Brannigan et al. | |
| 8,117,907 | B2 | 2/2012 | Han et al. | |
| 8,125,848 | B2 | 2/2012 | Geerits et al. | |
| 8,136,406 | B2 | 3/2012 | Sato et al. | |
| 8,468,882 | B2 | 6/2013 | Anish et al. | |
| 8,484,858 | B2 | 7/2013 | Brannigan et al. | |
| 8,783,099 | B2 | 7/2014 | Lilly et al. | |
| 8,788,207 | B2 | 7/2014 | Pei et al. | |
| 8,905,148 | B2 | 12/2014 | Nelson et al. | |
| 9,085,959 | B2 * | 7/2015 | Bittar | E21B 47/013 |
| 9,217,323 | B2 | 12/2015 | Clark | |
| 9,354,050 | B2 | 5/2016 | Moake | |
| 9,411,068 | B2 | 8/2016 | Bittar et al. | |
| 9,708,902 | B2 | 7/2017 | Lépez Rodriguez | |
| 9,766,362 | B2 | 9/2017 | Li et al. | |
| 9,829,597 | B2 | 11/2017 | Zeroug et al. | |
| 9,869,537 | B2 | 1/2018 | Hidaka et al. | |
| 9,951,604 | B2 * | 4/2018 | Hay | E21B 17/00 |
| 9,963,954 | B2 | 5/2018 | Al-Mulhem | |
| 9,963,964 | B2 * | 5/2018 | Jones | E21B 47/085 |
| 10,113,409 | B2 | 10/2018 | Thompson | |
| 10,132,954 | B2 | 11/2018 | Donderici | |
| 10,208,546 | B2 * | 2/2019 | Krid | E21B 3/04 |
| 10,217,279 | B2 | 2/2019 | Whalley et al. | |
| 10,267,725 | B2 | 4/2019 | Keightley et al. | |
| 10,329,899 | B2 | 6/2019 | Zheng et al. | |
| 10,385,627 | B2 * | 8/2019 | Bailey | E21B 17/1078 |
| 10,585,202 | B2 | 3/2020 | Sakiyama et al. | |
| 10,605,582 | B2 | 3/2020 | Ohmer et al. | |
| 10,794,124 | B2 * | 10/2020 | Roberson | E21B 17/1078 |
| 10,838,097 | B2 | 11/2020 | Dollfus et al. | |
| 11,530,579 | B2 * | 12/2022 | Sahdev | E21B 47/10 |
| 11,578,585 | B2 | 2/2023 | Al-Huwaider et al. | |
| 11,593,912 | B2 | 2/2023 | Fouda | |
| 12,000,266 | B2 * | 6/2024 | Thompson | E21B 47/08 |
| 2002/0062992 | A1 | 5/2002 | Fredericks et al. | |
| 2004/0095847 | A1 | 5/2004 | Hassan et al. | |
| 2005/0205248 | A1 | 9/2005 | Barolak et al. | |
| 2005/0283315 | A1 | 12/2005 | Haugland | |
| 2006/0064889 | A1 | 3/2006 | Fredette et al. | |
| 2009/0101337 | A1 | 4/2009 | Neidhardt | |
| 2010/0319991 | A1 | 12/2010 | Brannigan et al. | |
| 2012/0055711 | A1 | 3/2012 | Brannigan et al. | |
| 2013/0118809 | A1 | 5/2013 | Veeningen | |
| 2014/0138084 | A1 | 5/2014 | Al-Mulhem | |
| 2014/0260590 | A1 | 9/2014 | Gerrie | |
| 2015/0000904 | A1 | 1/2015 | Endo | |
| 2015/0136385 | A1 * | 5/2015 | Ratcliffe | E21B 47/017 166/113 |
| 2015/0323697 | A1 | 11/2015 | Ohmer et al. | |
| 2016/0003029 | A1 | 1/2016 | Hay | |
| 2016/0032717 | A1 | 2/2016 | Parker | |
| 2016/0061776 | A1 | 3/2016 | Aslanyan et al. | |
| 2017/0246778 | A1 * | 8/2017 | Trowbridge | E21B 47/01 |
| 2018/0038222 | A1 | 2/2018 | Samson et al. | |
| 2020/0049481 | A1 | 2/2020 | Harrigan et al. | |
| 2021/0270093 | A1 * | 9/2021 | Fripp | F16L 1/10 |
| 2023/0266112 | A1 | 8/2023 | McMath | |

FOREIGN PATENT DOCUMENTS

| | | | |
|---|---|---|---|
| CA | 2935817 | C | 5/2019 |
| CN | 202194653 | U | 4/2012 |
| CN | 202421128 | U | 9/2012 |
| CN | 102337884 | B | 7/2014 |
| CN | 103510949 | B | 2/2017 |
| CN | 106533929 | B | 8/2019 |
| CN | 108571317 | B | 5/2021 |
| DE | 102016103166 | A1 | 8/2017 |
| FR | 2803028 | A1 | 6/2001 |
| FR | 2803028 | B1 | 6/2002 |
| GB | 2086055 | B | 4/1985 |
| GB | 2254921 | A | 10/1992 |
| GB | 2585328 | B | 7/2021 |
| JP | 4376592 | B2 | 12/2009 |
| SU | 1686148 | A1 | 10/1991 |
| WO | 2009001022 | A1 | 12/2008 |
| WO | 2011146889 | A1 | 11/2011 |
| WO | 2012068205 | A2 | 5/2012 |
| WO | 2013050791 | A1 | 4/2013 |
| WO | 2015130317 | A1 | 9/2015 |
| WO | 2015195552 | A1 | 12/2015 |
| WO | 2017069745 | A1 | 4/2017 |
| WO | 2017200523 | A1 | 11/2017 |
| WO | 2019056536 | A1 | 3/2019 |
| WO | 2019215070 | A1 | 11/2019 |
| WO | 2020033041 | A1 | 2/2020 |
| WO | 2020117271 | A1 | 6/2020 |
| WO | 2021074792 | A1 | 4/2021 |

OTHER PUBLICATIONS

Patent Cooperation Treaty International Search Report for PCT/CA2021/050337 completed May 3, 2021.

(56) References Cited

OTHER PUBLICATIONS

Webpage of SonicScope from Schlumberger, as of Oct. 22, 2021: https://web.archive.org/web/20211022152720/https://www.slb.com/drilling/surface-and-downhole-logging/logging-while-drilling-services/sonicscope-multipole-sonic-while-drilling-service.
Webpage of Logging While Drilling from Haliburton as of Dec. 14, 2021: https://web.archive. org/web/20211214231559/https://www.halliburton.com/en/subsurface/formation-evaluation/logging-while-drilling.
Webpage of PixStar High Resolution Ultrasonic Imaging Service from Haliburton as of Dec. 15, 2021: https://web.archive.org/web/20211215192236/https://www.halliburton.com/en/products/pixstar-high-resolution-ultrasonic-imaging-service.
Webpage of ImageTrak high-resolution ultrasonic borehole imaging service from Baker Hughes as of Jun. 15, 2021: https://web.archive.org/web/20210615194026/https://www.bakerhughes.com/integrated-well-services/integrated-well-construction/evaluation/loggingwhiledrilling-services/lwd-imaging/imagetrak-highresolution-ultrasonic-borehole-imaging-service.
Webpage of FracView® LWD Borehole Imager from Nabors as of Nov. 27, 2021: https://web.archive.org/web/20211127202639/https://www.nabors.com/drilling-solutions/directional-automation/petromar-logging-while-drilling/fracview-lwd-borehole.

* cited by examiner

METHOD AND APPARATUS FOR MEASURING A WELLBORE

BACKGROUND OF THE INVENTION

Field of the Invention

The present invention relates generally to measuring wellbores and in particular to an apparatus and methods for engaging measuring sensors with a wellbore from an in line tool within a drill string.

Description of the Related Art

In oilfield applications, tubular wells (boreholes or wellbores) are directionally drilled through the earth using a drilling string suspended from a drilling rig. A drilling string is a collection of assembled parts including drill pipe, drill collars, tools and the drill bit. The parts are threadably coupled together to form the drill string, with the drill bit on the distal end of the string. The drilling rig may include equipment to rotate the drilling string, or the drilling string may include a mud motor, which uses hydraulic energy from drilling fluid to turn the drill bit, independent of the drill string. The drilling fluid, also known as drilling mud, passes through the interior of the drilling string, exiting the string at the drill bit and is subsequently pumped back to the surface around the exterior of the drilling string, carrying the drill cuttings with it for treatment and disposal.

It is desirable and common practice to measure the physical properties of the wellbore during or following drilling operations. Information may be obtained about the well path and position, depth, bottom-hole location, geophysical properties of the rock, etc. This information can be used to optimize the efficiency of the wellbore placement and provide information for future well use as well as any remedial steps which must be performed on the wellbore.

Measurement while drilling (MWD) components may include a variety of sensors which allow for continued drilling operation while collecting data with the sensors. It should be noted that in the art it is known to distinguish between the terms "measurement while drilling" (MWD) and "logging while drilling" (LWD) in that the MWD term generally refers to measurements relating to the progress of the drilling operation (such as the trajectory, rate of penetration, etc.), whereas LWD relates to information about the wellbore physical properties (such as the porosity of the rock, vertical seismic profile, etc.). For the purpose of the description of the present invention, "wellbore measurement" is intended to cover both classifications of sensors, without limiting the type of sensors that may be described below.

Conventional methods of wellbore measurement have included tools with multiple sensors. However, many of these tools are separate from the drill string, not permitting a fluid bypass, and thus drilling operation must be ceased and the drill string may need to be removed before such tools can be inserted for measurements to be taken. Examples of such devices with multiple sensors include CN102337884, CN202194563 and CN20241128, U.S. Pat. No. 7,698,937 to Neidhardt, U.S. Pat. No. 4,673,890 to Copeland et al., U.S. Pat. No. 7,281,578 to Nakajima et al. and US Patent Application Publication No. 2014/0138084 to Al-Mulhem.

Applicant is aware of wall contact caliper instruments for use in a drilling string which include a bypass passage through the tool such that the drilling operation does not need to be ceased while measurements are taken. Such devices do not detect the profile of the wellbore directly, but rather detect the difference in the height between the top and bottom of the tool to measure the average diameter of the bore. Examples of such devices may be found in U.S. Pat. No. 8,024,868 to Brannigan et al.

BRIEF SUMMARY OF THE INVENTION

This invention has a number of aspects. These include without limitation:

1. tools for profiling wellbores.
2. methods for profiling wellbores.
3. methods for deploying tools for profiling wellbores.

According to a first embodiment of the present invention there is disclosed a method of activating a tool located within a drill string within a wellbore, the method comprising fixedly securing a tool in-line with a rotatable drill string, locating the tool at a desired location within the wellbore, sensing a pre-determined rotary pattern in the drill string and the tool with a sensor associated with the tool and activating an actuator in the tool in response to the sensing of the pre-determined pattern. The pattern may be a rotary pattern of the drill. The pattern may be a timed pattern of the flow rate of the drilling fluid. Other activation methods may include ball drops and electromagnetic signals.

The pre-determined rotary pattern may comprise a pre-determined sequence of rotary speed of the drill string. The sensor may be adapted to output an electrical signal representing rotary speed to an associated processor adapted to detect the pre-determined sequence as outputted by the sensor. The actuator may comprise an electric motor. The electric motor may activate a change in the location of one or more retaining devices. The retaining devices may utilize magnetic attraction or mechanical interference.

According to a first embodiment of the present invention there is disclosed an apparatus for measuring at least one characteristic of a wellbore comprising an elongate outer casing extending between first and second ends, the first and second ends having connectors connectable in-line to a drill string, a plurality of arms rotatably supported around a periphery of the outer casing, each of the plurality of arms having a retaining body and a release body operable to detachably retain the retaining members proximate to the outer casing and to selectably release the retaining members and the plurality of arms to rotate away from the outer casing into contact with the wellbore.

The retaining body may comprise arm magnets secured to the plurality of arms. The magnets may be embedded within the plurality of arms. The release body may include a plurality of inner magnets adapted to selectably engage with corresponding arm magnets. The release body may comprise a rotatable member located inside the outer casing wherein rotation of the rotatable member selectably aligns and miss-aligns the inner magnets with the arm magnets so as to retract or release the arms.

According to a first embodiment of the present invention there is disclosed a method for measuring at least one characteristic of a wellbore comprising locating an elongate outer casing extending between first and second ends in line with a drill string, extending a plurality of arms into contact with the wellbore, the plurality of arms being rotatably supported around a periphery of the outer casing, each of the plurality of arms having a retaining body and a release body operable to detachably retain the retaining members proximate to the outer casing and to selectably release the retaining members and the plurality of arms to rotate away from the outer casing.

Another aspect of the invention provides apparatus for measuring the profile of a wellbore. The apparatus comprises: a cylindrical body having first and second ends threaded for connection in line with a drill string and a passage extending through the body between the first and second ends; a plurality of arms pivotally coupled on an outer surface of the cylindrical body, each of the arms biased to pivot so as to move a free end thereof radially away from the outer surface of the body, the plurality of arms angularly spaced apart around the cylindrical body and arranged in a plurality of tiers, each of the tiers comprising three or more of the arms, the tiers being spaced apart axially from one another along the cylindrical body; sensors operable to directly or indirectly measure radial extension of each of the arms from the cylindrical body; and a holding mechanism operable to hold the arms in a retracted configuration and to selectively release the arms to pivot away from the cylindrical body.

There is also provided a wellbore measuring apparatus according to a further aspect. The wellbore measuring apparatus includes an outer body that is tubular with spaced-apart ends threaded for connection in line with a drill string. The wellbore measuring apparatus includes a plurality of sensors operatively coupled to and axially spaced along the outer body. Each sensor is arranged to measure at least one characteristic of a wellbore. The wellbore measuring apparatus includes at least one rib coupled to and extending radially outwards from the outer surface of the outer body. The at least one rib is helical in shape and with the plurality of sensors extending along and being adjacent to the at least one rib.

There is further provided a wellbore measuring apparatus according to an additional aspect. The wellbore measuring apparatus includes an outer body that is tubular with spaced-apart ends threaded for connection in line with a drill string. The outer body has a plurality of recesses extending around the outer surface thereof in one or more helical patterns. The wellbore measuring apparatus includes a plurality of sensors operatively coupled to and each positioned within a respective said recess of the outer body. Each sensor is arranged to measure at least one characteristic of a wellbore.

There is yet also provided a wellbore measuring apparatus according to another aspect. The wellbore measuring apparatus includes an outer body that is tubular with spaced-apart ends threaded for connection in line with a drill string. The wellbore measuring apparatus includes at least one wellbore-characteristic sensor operatively coupled to the outer body and arranged to measure at least one characteristic of a wellbore. The wellbore measuring apparatus includes an additional sensor configured to measure one or more characteristics indicative of a flow of fluid through the outer body. The wellbore measuring apparatus includes a processor configured to process a signal from the additional sensor, recognize a pre-determined pattern therefrom and selectively control and/or activate the at least one wellbore-characteristic sensor in response to recognizing the pre-determined pattern.

In some embodiments, arms of each of the tiers are equally angularly spaced apart around the cylindrical body.

In some embodiments, each of the tiers comprises 3 to 8 of the arms.

In some embodiments, the arms of each of the plurality of tiers are angularly offset relative to the arms of other ones of the plurality of tiers.

In some embodiments, the angular offsets between any pair of the tiers is substantially equal to 360 degrees divided by a total number of the arms in the plurality of tiers or a multiple thereof.

In some embodiments, each of the tiers comprises four or more of the arms.

In some embodiments, the arms of each of the tiers are angularly spaced apart at 90 degree intervals around the cylindrical body.

In some embodiments, the sensors comprise magnetic sensors arranged to detect magnetic fields from magnets carried by the arms and to output signals indicative of pivot angles of the arms.

In some embodiments, the sensors comprise triaxial magnetic sensors.

In some embodiments, the arms are pivotally mounted to pivot axes oriented perpendicularly to a longitudinal centreline of the cylindrical body.

In some embodiments, the arms are pivotally mounted to pivot axes oriented at acute angles to a longitudinal centreline of the cylindrical body.

In some embodiments, the cylindrical body is formed with grooves that extend longitudinally along the body, wherein each of the grooves passes between adjacent arms of a plurality of the tiers of arms.

In some embodiments, the grooves are helical grooves.

In some embodiments, the grooves have a helix angle such that in travelling between two of the tiers the grooves travel circumferentially around the cylindrical body by an angle that is substantially equal to an angular offset of the two of the tiers.

In some embodiments, the arms are mounted to ridges that extend between adjacent ones of the grooves.

In some embodiments, centrelines of the arms are longitudinally aligned with the ridges on which the arms are mounted.

In some embodiments, the arms are arranged in at least three of the tiers.

In some embodiments, the cylindrical body is formed with recesses and each of the plurality of arms is pivotally retractable into a corresponding one of the recesses.

In some embodiments, the recesses are shaped to conform to an outer profile of the corresponding arm.

In some embodiments, the free ends of the arms have rounded configurations.

In some embodiments, the free ends of the arms comprises a wear resistant material.

In some embodiments, the free ends of the arms comprise a hardened button made of a wear resistant material.

In some embodiments, the wear resistant material is poly crystalline diamond.

In some embodiments, the hardened button has a diameter of 1 centimeter or less.

In some embodiments, the arms are mounted to the cylindrical body by pivot members that are pivotally mounted to the cylindrical body.

In some embodiments, some or all of the arms each include additional sensors.

In some embodiments, the additional sensors comprise one or both of temperature sensor(s) and radius proximity sensor(s).

In some embodiments, the arms have lengths in the range of 3 to 15 inches.

In some embodiments, the arms have lengths of 6½ inches±1½ inches.

In some embodiments, the holding mechanism comprises one or more of a hydraulic actuator, an electric actuator, a magnetic system and a pneumatic actuator.

In some embodiments, the holding mechanism comprises: a rotatable sleeve that carries a plurality of sleeve magnets that provide magnetic poles spaced apart around the magnetic sleeve, the sleeve magnets movable by rotating the sleeve between attractive positions wherein each of the arms of a tier is held in a retracted position by magnetic attraction to a corresponding one of the sleeve magnets and non-attractive positions wherein the arms are allowed to pivot away from the cylindrical body.

In some embodiments arm magnets are provided on the arms, the arm magnets aligned with corresponding ones of the sleeve magnets when the sleeve magnets are in the attractive positions.

In some embodiments, the sleeve magnets are stronger than the arm magnets.

In some embodiments, the sleeve magnets comprise neodymium magnets.

In some embodiments, the sleeve magnets comprise ¾ inch diameter circular neodymium magnets.

Some embodiments comprise a motor coupled to drive rotation of the sleeve relative to the arms.

Some embodiments comprise one or more magnetic transfer bodies embedded in the cylindrical body between the sleeve magnets and the corresponding arms.

Some embodiments comprise a data processor connected to receive output signals from the sensors and to log the output signals.

Some embodiments comprise a toolface sensor wherein the processor is configured to log readings from the toolface sensor indicating an orientation and/or position of the cylindrical body.

In some embodiments the processor is configured by firmware to process the signals from the sensors to determine a profile of a wellbore.

Some embodiments comprise a revolutions sensor configured to measure a speed of rotation of the cylindrical body.

In some embodiments the processor is configured to process a signal from the revolutions sensor, recognize a pre-determined pattern of rotational speeds and operate the holding mechanism in response to recognizing the pre-determined pattern.

Some embodiments comprise one or both of a vibration sensor and a fluid flow rate sensor.

In some embodiments the processor is configured to process a signal from the vibration sensor and/or the fluid flow rate sensor, recognize a pre-determined pattern of vibration and/or fluid flow and operate the holding mechanism in response to recognizing the pre-determined pattern.

Some embodiments comprise a trajectory sensor configured to measure one or more of inclination, roll angle and azimuth of the apparatus.

Another aspect of the invention provides apparatus having any new and inventive feature, combination of features, or sub-combination of features as described herein.

Another aspect of the invention provides methods for measuring a profile of a wall of a wellbore. The methods comprise: connecting apparatus according to any of the preceding claims into a drill string; lowering the drill string into the wellbore; releasing the arms and allowing the arms to pivot outwardly to contact the wall of the wellbore; and withdrawing the drill string from the wellbore while recording signals from the sensors and/or processing the signals from the sensors to determine the profile of the wall of the wellbore.

Another aspect of the invention provides methods having any new and inventive steps, acts, combination of steps and/or acts or sub-combination of steps and/or acts as described herein.

Further aspects and example embodiments are illustrated in the accompanying drawings and/or described in the following description.

It is emphasized that the invention relates to all combinations of the above features, even if these are recited in different claims.

BRIEF DESCRIPTION OF THE DRAWINGS

The accompanying drawings illustrate non-limiting example embodiments of the invention.

DESCRIPTION OF THE PREFERRED EMBODIMENTS

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Figure 1:
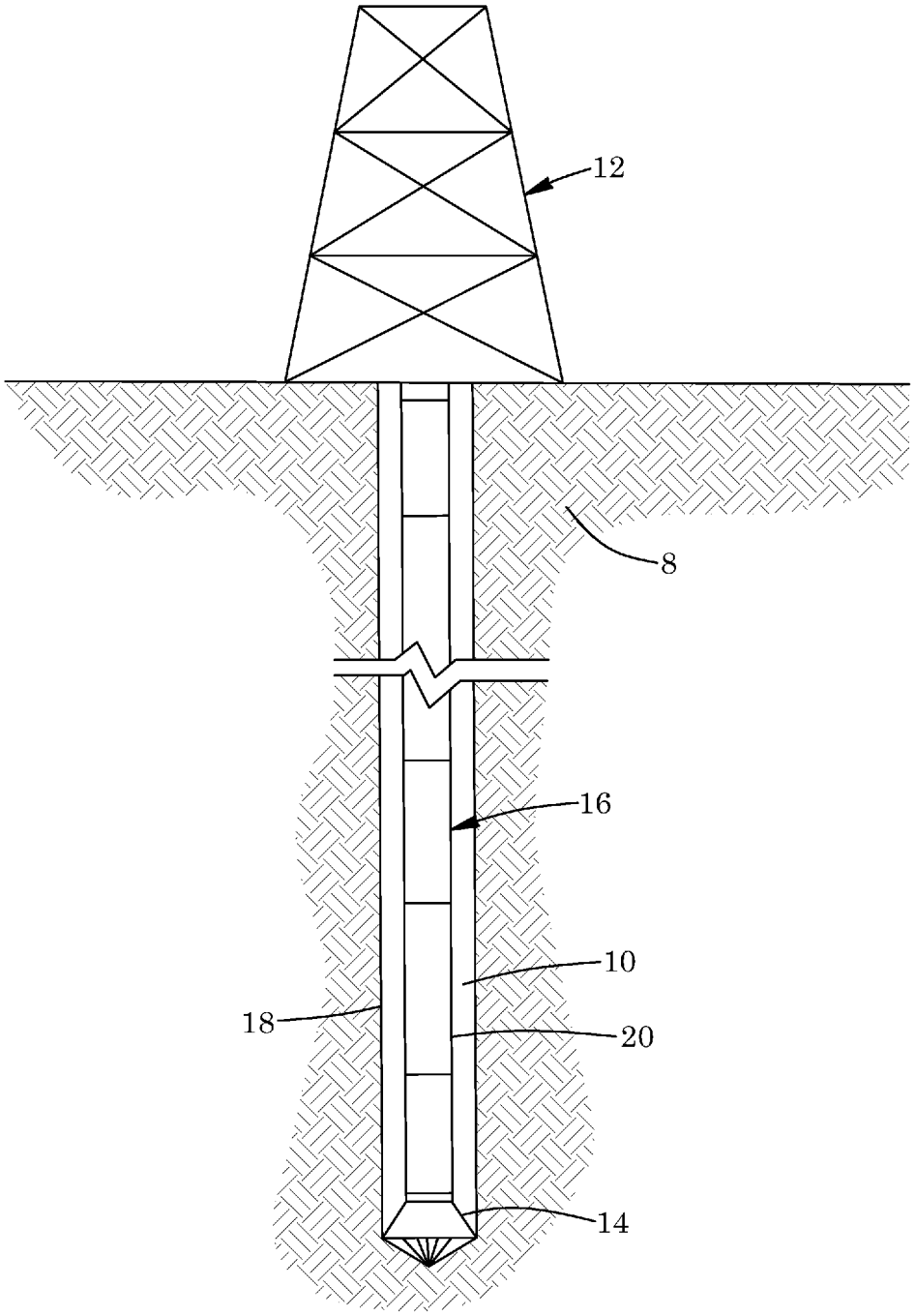
FIG. 1 is a cross sectional view of a wellbore having a drilling string therein which includes an apparatus for measuring the wellbore wall.

Referring to FIG. 1, a wellbore 10 is drilled into the ground 8 by known methods. The production zone may contain a horizontally extending hydrocarbon bearing rock formation or may span a plurality of hydrocarbon bearing rock formations such that the wellbore 10 has a path designed to cross or intersect each formation. As illustrated in FIG. 1, the wellbore 10 includes a drilling rig 12 at a top end thereof and a drilling or bottom hole assembly 14 at a distal end of a drill string 16 extending therebetween. As illustrated in FIG. 1, a wellbore measuring tool 20 is located within the drill string 16 for measuring the properties and characteristics of the wellbore wall 18 as will be further described below. The wellbore measuring tool may be referred to as a wellbore measuring apparatus.

Figure 2:
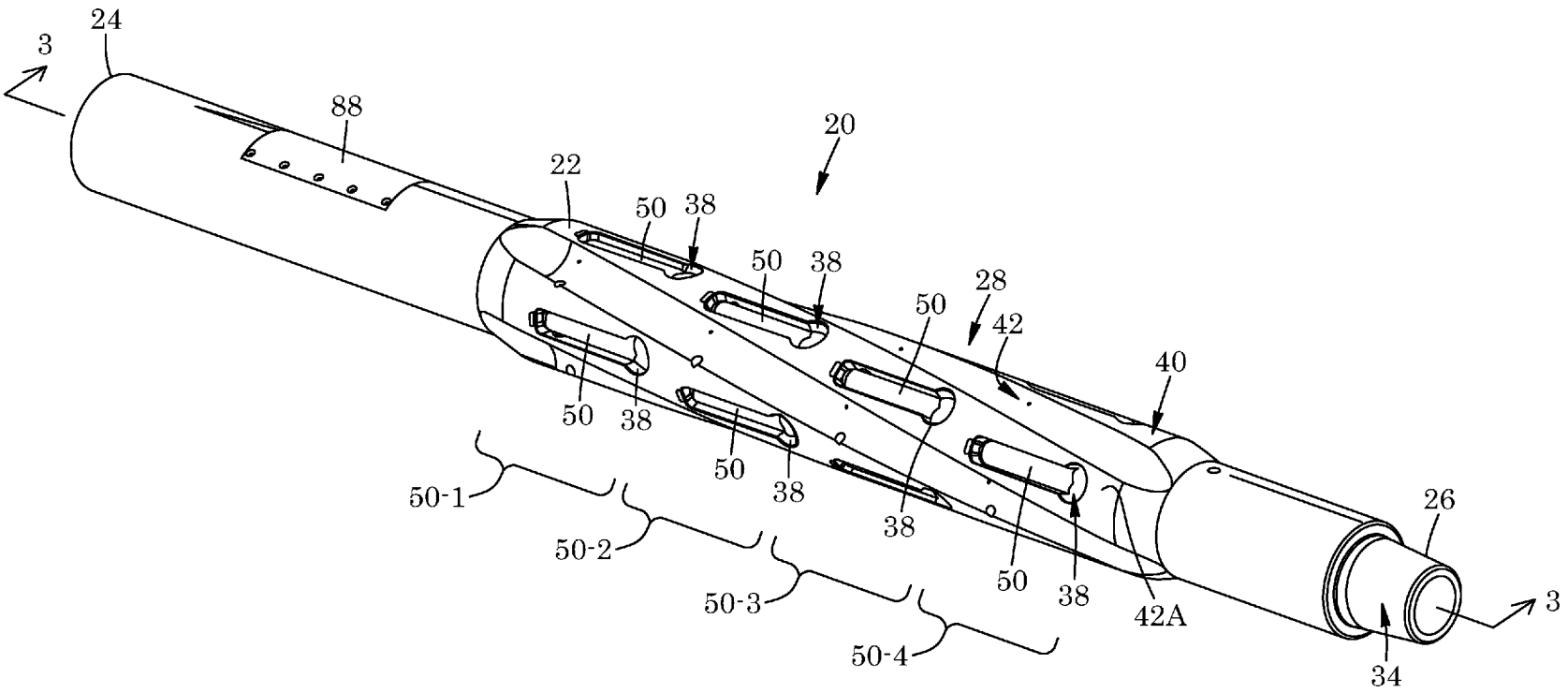
FIG. 2 is a perspective view of a wellbore measuring apparatus for use in the drilling string of FIG. 1.
Figure 3:
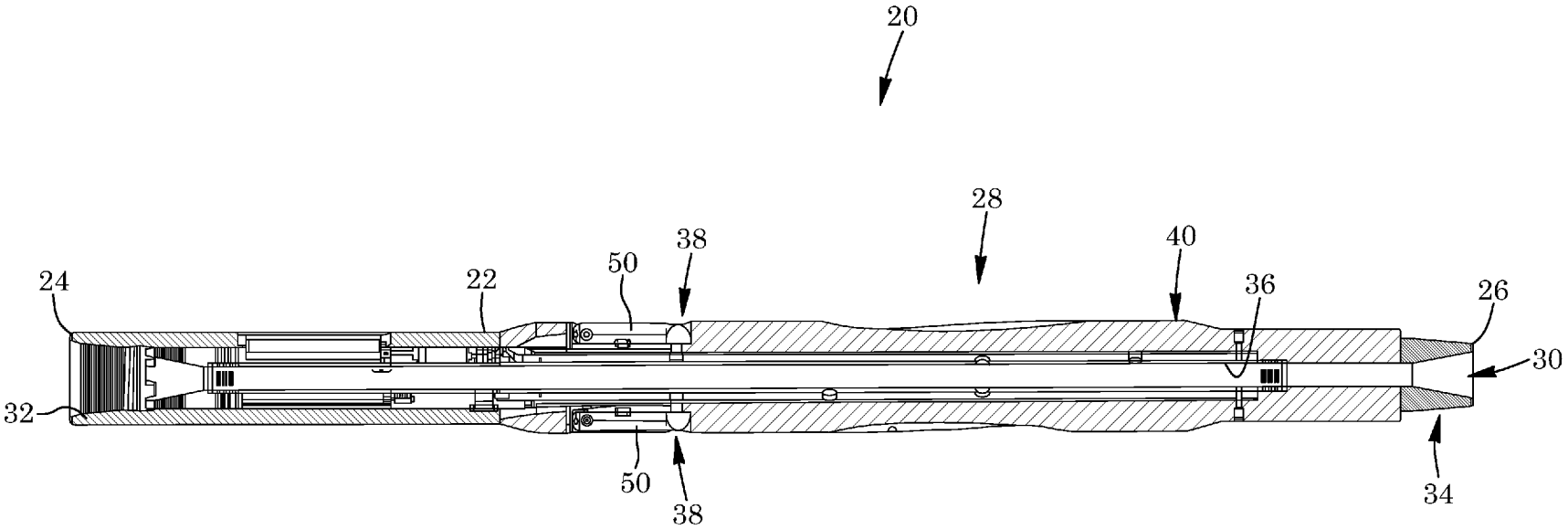
FIG. 3 is a cross-sectional view of the apparatus of FIG. 2 taken along line 3-3 in a first or retracted position.

Turning to FIGS. 2 and 3, a tool 20 for measuring a wellbore 10 as set out above comprises an outer casing 22 extending between first and second ends, 24 and 26, respectively and including a middle portion 28 located between ends 24 and 26.

Figure 4:
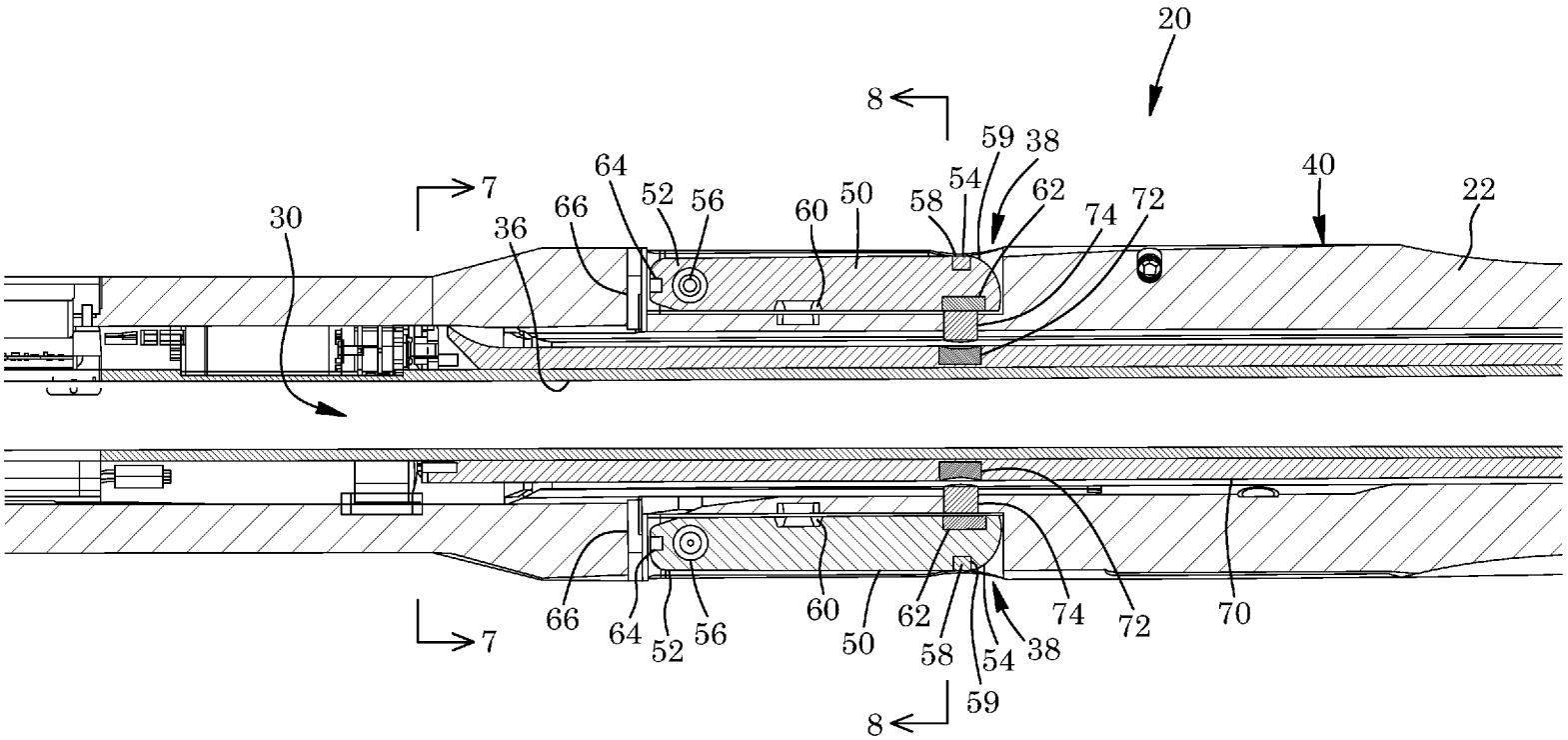
FIG. 4 is a detailed cross-sectional view of the apparatus of FIG. 2 taken along line 3-3 around a first set of arms in a first or retracted position.

As illustrated in FIGS. 3 and 4, tool 20 includes a plurality of spring biased sensor arms 50 extendable into contact with, or proximity to the wellbore wall 18 as will be described further below. Outer casing 22 is sized to be coupled within the drill string 16, and has internal end threading 32 at first end 24 and external end threading 34 at second end 26. Internal and external threading, 32, 34, are selected to correspond to and be matable with other drill string threading, as are commonly known. Outer casing 22 defines an interior passage 30 therethrough formed by an inner sleeve 36 extending through outer casing 22 from first end 24 to second end 26.

Outer casing 22 may also include a compartment for containing one or more electrical components, as set out below, A compartment is illustrated as being contained by a cover 88 in FIG. 2 by way of non-limiting example.

Middle portion 28 includes a plurality of recesses 38 in an outer surface 40 thereof. As illustrated in FIG. 2, the plurality of recesses 38 may be arranged around outer surface 40 in a spiral or helical pattern with helical passages or grooves 42 formed into outer surface 40 between recesses 38. There may be equal spacing between recesses 38. Recesses 38 each contain a pivoting sensor arm 50.

In some embodiments, arms 50 are oriented such that with tool 20 connected in-line with a drill string, arms 50 extend in a downhole direction from the locations at which arms 50 are coupled to the body of tool 20.

Figure 5:
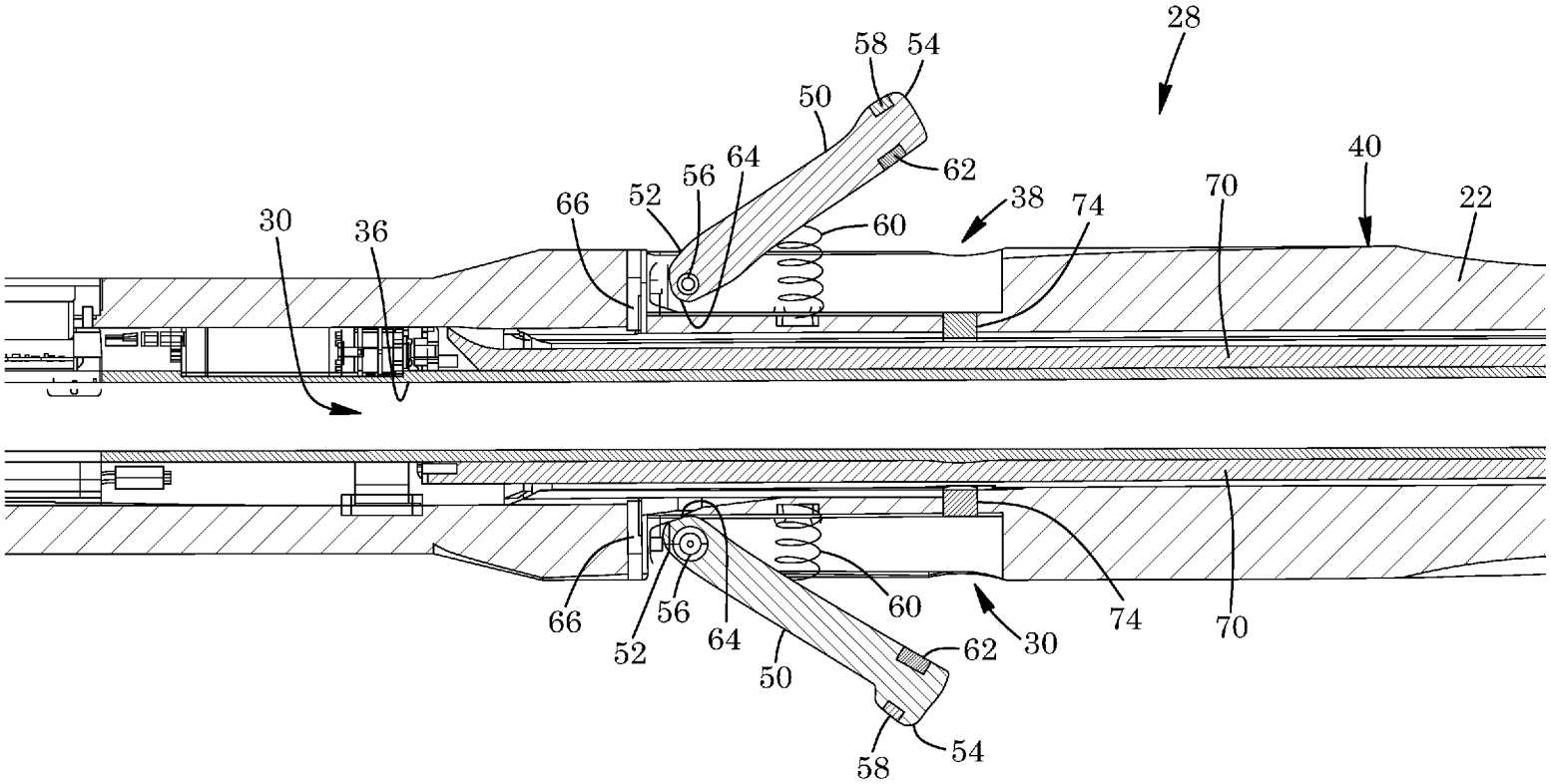
FIG. 5 is a detailed cross-sectional view of the apparatus of FIG. 2 taken along line 3-3 around a first set of arms in a second or extended position.

As shown in FIGS. 4 and 5, arms 50 are each pivotally connected to outer casing 22 at one end 52, for example by a pin 56 or the like. An arm 50 can therefore pivot between a retracted position in which the arm 50 is received in a corresponding recess 38 and an extended position in which a free end 54 of the arm 50 projects out of recess 38 and extends outwardly away from outer surface 40. When tool 20 is in use, arms 50 are pivoted out of recesses 38 to until ends 54 engage or are proximate to a wall of a wellbore.

Arms 50 are biased away from outer casing 22 and out of the recess 38, for example, by a bias mechanism such as a spring 60 or a suitable actuator. The bias mechanism may supply sufficient force to bias ends 54 of the corresponding arm 50 into contact with wall 18. For example, ends 54 may apply a radially directed force to wall 18 having a magnitude in the range of about 15 lbs force to about 20 lbs force.

In some embodiments spring 60 comprises a coil spring or a leaf spring or a gas spring.

Ends 54 of arms 50 may comprise a rounded or smoothed portion. A rounded or smoothed portion may reduce friction and binding as end 54 moves along wellbore wall 18.

In some embodiments a wall-contacting portion at end 54 is made of or coated with a wear-resistant material. For example, ends 54 may each carry a hardened button 58 comprising a wear-resistant material. In some embodiments hardened button 58 has a diameter of about 1 cm. In some embodiments, hardened button 58 has a diameter of less than 1 cm.

Various suitable wear resistant materials are known. By way of non-limiting example, the wear-resistant material may comprise poly crystalline diamond ("POD"). A hardened button 58 made of poly crystalline diamond may advantageously reduce wear of parts of arms 50 that are in contact with wellbore wall 18. Wearing down of ends 54 of arms 50 that are in contact with wellbore wall 18 is disadvantageous because such wear may impact arm angle measurement.

A profile of the wall 18 of the wellbore may be obtained by processing measured positions of arms 50 as tool 20 is moved along the wellbore. To this end, tool 20 includes a mechanism operable to directly or indirectly determine positions of ends 54 of arms 50 relative to outer casing 22. For example, tool 20 may comprise sensors configured to directly or indirectly measure pivot angles of arms 50.

In some embodiments an angle sensing mechanism comprises a position sensor 66 in or on outer casing 22 that is operative to sense an angle of a corresponding arm 50. In some embodiments position sensor 66 is located in a housing proximate to pin 56.

In some embodiments, position sensor 66 is a magnetic sensor, for example a triaxial magnetic sensor. For example, position sensor 66 may detect a magnetic field from a magnet 64 that is mounted to move relative to sensor 66 as the corresponding arm pivots. Magnet 64 may, for example, be mounted to end 52 of arm 50. The angle at which an arm 50 is pivoted relative to outer casing 22 may be determined by processing the output signal from the corresponding sensor 66.

The point relative to outer casing 22 at which arm 50 contacts wall 18 of a wellbore may be determined by trigonometry, given the dimensions of the arm 50 and the angle to which the arm 50 is pivoted. The points at which the plurality of arms 50 contact wall 18 may be processed to determine the diameter and profile of wellbore 10 at the position of tool 20.

In some embodiments the data gathered by each position sensor 66, for example a magnetic response of position sensor 66 where sensor 66 comprises a magnetic sensor, is relayed to electronics in tool 20 that logs the data and/or parses the data gathered from position sensor 66 to determine the profile of wellbore 10. It is not mandatory that ends 54 of arms 50 make contact with wall 18 of a wellbore. In some embodiments arms 50 include proximity sensors 59 that are operable to sense a distance to wall 18. In such embodiments measured positions of arms 50 may be combined with output signals from proximity sensors 59 to determine locations of points on wall 18 relative to tool 20.

Optional sensors 59 may be of any suitable type or types. For example, sensors 59 may include sensors that have functions instead of or in addition to proximity sensing. For example, sensors 59 may include one or more of: radial proximity sensors, ultrasonic sensors (e.g. operable to measure properties of drilling fluid), acceleration sensors, force sensors and temperature sensors. Sensors 59 may include sensors selected to measure any desired characteristic of the wellbore as known in the art.

In some embodiments, one or more sensor(s) 59 are contained within a cavity in an arm 50. Sensor(s) 59 may be provided at different locations on an arm 50.

In some embodiments, sensor(s) 59 and/or sensors (e.g. sensors 66) that generate signals that indicate pivot angles of arms 50 are connected by electrical conductors to electronics enclosed within outer casing 22. The electrical conductors may extend through suitable passages in the body of tool 20. The electronics may, for example include one or more electronic memories 102 and/or one or more processors 100 and/or suitable firmware.

In some embodiments, the electronics are configured to perform one or more of:

1. transmit data gathered by sensor(s) 59 and/or arm pivot angle sensors (e.g. sensors 66) to surface equipment (e.g. by a suitable telemetry transmitter);
2. store or log readings from sensors 59;
3. store or log readings from arm pivot angle sensors (e.g. sensors 66);
4. process outputs of the sensors to yield information specifying a profile of wall 18 and/or intermediate data such as angles of arms 50 that can be further processed to obtain information about the profile of wall 18.

Tool 20 has multiple arms 50 that are angularly spaced apart around outer casing 22. The angular resolution with which tool 20 can measure contours of wall 18 may be increased by increasing the number of arms 50. For example, four arms 50, equally angularly spaced apart can provide an angular resolution of 90 degrees. Increasing the number of arms 50 to 8 or 16 or 32 equally angularly spaced apart arms can increase angular resolution to 45 degrees, 22.5 degrees and 11.25 degrees respectively. However, it is generally desirable to arrange arms 50 so that they allow drilling fluid to pass by tool 20 and so that different arms 50 do not interfere with one another.

In some embodiments, arms 50 are arranged in two or more tiers that are longitudinally spaced apart along tool 20. Each tier may include several arms 50 (e.g. 2 to 6 or 8 arms 50) that are angularly spaced apart around tool 20. Different tiers may be angularly offset with respect to one another to provide a finer angular spacing of arms 50 than is provided in any of the tiers. For example, the embodiment illustrated in FIG. 2 includes 16 arms 50 arranged in four tiers 50-1 50-2, 50-3, and 50-4 with four arms 50 in each of the tiers. In each tier the four arms are spaced apart angularly by 90 degrees. Different pairs of the tiers are angularly offset by 22.5 degrees or a multiple of 22.5 degrees. In the FIG. 2 example embodiment the angular offsets of adjacent tiers match the angular travel of grooves 42 between adjacent tiers.

Different tiers of arms 50 may be longitudinally spaced apart along tool 20 by suitable distances. In some embodiments adjacent tiers are spaced apart by distances that slightly exceed the lengths of arms 50. In some embodiments adjacent tiers are spaced apart by distances that are on the order of a gauge diameter of the wellbore 10 for which tool 20 is designed. In some embodiments adjacent tiers are spaced apart by distances in the range of about 5 to 20 inches.

Embodiments with 16 arms 50 have example application where higher angular resolution is desired, for example in evaluating large open hole wellbores as are common, for example, in offshore drilling. For example, apparatus like that shown in FIG. 2 may be advantageous in evaluating a wellbore 10 having a diameter of about 200 mm or more.

Other arrangements of arms 50 are possible. For example in some embodiments, tool 20 has four arms 50. In such embodiments, arms 50 may be positioned around outer surface 40 to have equal angular spacing between arms 50. In such embodiments, adjacent arms 50 may be positioned 90 degrees apart around outer surface 40. Embodiments with four arms 50 have applications in smaller diameter bores for example in diamond drilling mining applications.

In some example embodiments, tool 20 includes eight arms 50. Embodiments with eight arms 50 have example applications in casing evaluations. The eight arms may, for example, be arranged in two tiers of four arms 50. The two tiers may be angularly offset by 45 degrees relative to one another.

In some other example embodiments, tool 20 has 12 arms 50. Embodiments with 12 arms 50 have example applications in evaluations of hybrid open holes and cased holes where somewhat greater angular resolution is desired. The 12 arms 50 may, for example be arranged in 3 tiers of 4 arms 50 each with the arms in different tiers or in 4 tiers of 3 arms 50 each with each pair of the tiers offset by 30 degrees or a multiple of 30 degrees relative to one another.

In any of these embodiments, arms 50 may be supported on ridges 42A located between helical grooves 42 where the helicity of helical grooves 42 and the longitudinal spacing between adjacent tiers is such that grooves 42 twist around outer surface 40 through an angle that is substantially equal to the angular offset between adjacent tiers as they run between adjacent tiers.

Arms 50 are long enough that within a permitted range of pivotal motion they can be extended radially sufficiently to contact wall 18 of a wellbore 10 of a specified diameter and sufficiently to contact portions of wall 18 which are oversized for any reason within a desired measurement range (e.g. a cavity in wall 18, a portion of wellbore 10 that is over-sized etc.). It is desirable that, at the maximum expected extension of arms 50 the arms 50 trail tool 20.

For example, an example embodiment of tool 20 may be used in a wellbore having a gauge diameter of 6⅛ inches. In this example, when tool 20 is centered in wellbore 10, at a location where wellbore 10 is cylindrical at the gauge diameter, arms 50 will contact wall 18 when they are radially extended by a small amount. Arms 50 may be long enough to contact wall 18 even when wellbore 10 is oversized by some amount (e.g. IA of the gauge diameter and/or up to a few inches).

For example, a tool 20 designed for use in a wellbore 10 having a gauge diameter of 6⅛ inches may have arms 50 long enough to contact wall 18 of a portion of wellbore 10 having a diameter of 9⅛ inches (3 inches over gauge).

In some embodiments arms 50 contact wall 18 at an angle of less than 35 or less than 30 or less than 25 degrees at their maximum intended measuring range (e.g. 3 inches over gauge or 1.25 times the gage diameter).

For the example case where tool 20 has a diameter of 4 inches with arms 50 fully retracted, arms 50 may contact wall 18 of a wellbore having a gauge diameter of 6⅛ inches when pivoted to extend radially outward of outer surface 40 by 1 1/16 inch and may contact wall 18 of a portion of the same wellbore that is 3 inches over gauge when pivoted to extend radially by 2 9/16 inches. Each arm 50 may, for example, have a length between a pivot axis and end 54 of 6½ inches (about 16.5 cm). With this geometry, an arm 50 extended to the maximum intended measuring range is angled at approximately 23 degrees to the longitudinal centerline of tool 20. Arms for tools 20 intended for use in larger or smaller wellbores may be scaled appropriately.

Tool 20 may be included in a drill string. When it is desired to use tool 20 to measure a profile of wall 18 arms 50 may be extended to contact wall 18. The drill string (including tool 20) may then be moved along the wellbore. In an example embodiment arms 50 are kept retracted during drilling and are extended while the drill string is being tripped out of the wellbore. The drill string may be not rotating or rotated slowly while the measurements are being made.

In some applications tool 20 is not rotating when using tool 20 to measure wellbore wall 18, In other applications tool 20 may be rotated while measuring wellbore wall 18. For example, the drill string and tool 20 may be rotated at a few RPM (e.g. up to about 10 rpm) while tool 20 is measuring wellbore wall 18.

Arms 50 ride along wall 18 of the wellbore in axial lines if the drill string is not rotating or along helical paths if the drill string is rotating. The helix angle of the helical paths depends on the rate of rotation and the speed with which the drill string is being drawn along the wellbore. With the helix angle defined as the angle between a line that extends axially along wall 18 and the helical path, the helix angle decreases if the speed of motion of tool 20 along the wellbore is increased or if the rate of rotation of tool 20 is decreased.

As arms 50 ride along their corresponding tracks on wall 18, arms 50 move in response to contours of wall 18. For example, if the track of an arm 50 passes over a cavity in wall 18 distal end 54 of arm 50 may move radially outwardly into the cavity as it passes over the cavity. In this manner contours of wall 18 may be measured. The measured contours of wall 18 may be mapped to specific locations along the wellbore by correlating the measurements with information from other sensors that indicate the location and orientation of tool 20 in the wellbore when the measurements are made.

The rotational orientation of tool 20 may be monitored by a sensor (e.g. a toolface sensor and/or magnetic sensor and/or inclinometer and/or azimuth sensor) which may be provided in tool 20 (or in another tool in the drill string). In some embodiments, tool 20 includes a toolface measurement tool that monitors the orientation of tool 20 in wellbore 10. Orientation may include measurements such as the inclination and azimuth of tool 20.

In some embodiments, tool 20 includes a marker. The marker may comprise, for example, one or more of arms 50. For example, the marker may comprise one or more pairs of two diametrically opposed arms 50. Using two diametrically opposed arms may provide information about the position of tool 20 within wellbore 10 in the plane of the diametrically opposed arms. The orientation, location and position of one or more such markers may logged. The orientation, location and position of the marker(s), may be applied in determining the locations at which arms 50 are engaging wall 18 of wellbore 10.

Measurements of wellbore 10 may be correlated to locations along wellbore 10 through directional surveys. Directional surveys align the data to coordinates of the wellbore (e.g. X, Y and Z coordinates or cylindrical coordinates r, θ, Z).

In the embodiment illustrated in FIG. 2, recesses 38 are oriented generally parallel to a longitudinal centreline of tool 20 and arms 50 pivot about axes that are generally at right angles to the longitudinal centreline of tool 20. In other embodiments, some or all of arms 50 are pivoted about axes that are at other angles to the longitudinal centreline of tool 20. In such embodiments recesses 38 may be angled in relation to the centreline of tool 20 to receive arms 50 when arms 50 are retracted. For example, in some embodiments, the centrelines of one or more of recesses 38 are oriented so that the recesses 38 are generally longitudinally aligned with ridges 42A between adjacent helical grooves 42. Arms 50 in such embodiments may be mounted to pivot about axes that extend substantially at right angles to the corresponding recesses 38.

Pivot axes of arms 50 may be angles so that when the drill string is rotating in a rotation direction, ends 54 of arms 50 trail the pivot axes of arms 50 with this arrangement, arms 50 are advantageously able to take more rotation load (i.e. the rotation creates less side load on the pivots of arms 50).

Tools 20 as described herein may have arms 50 connected to the body of tool 20 by pivots having axes oriented perpendicular to or at another angle relative to a longitudinal centreline of tool 20. In some embodiments, one or more arms 50 is longitudinally aligned with a helical ridge 42A on which the arm 50 is mounted.

In some embodiments the pivots about which arms 50 rotate are themselves pivotable relative to the body of tool 20 (e.g. about an axis perpendicular to the longitudinal centreline of tool 20). Such embodiments may advantageously allow arms 50 to swing to match the helix angle defined by the rotation (if any) and speed of advancement of tool 20 along wellbore 10. In such embodiments sensors may be provided to measure the angles of rotation of the pivot axes of arms 50 and outputs from these sensors may be used to correlate readings of arms 50 with contours at specific locations on wall 18 of wellbore 10.

In some embodiments, tool 20 includes a mechanism for managing arms 50. The mechanism may be operable, for example to selectively release arms 50 when it is desired to use tool 20 for measurement of contours of wall 18 as described herein. The mechanism may include latches of other devices to retain arms 50 in recesses 38 until it is desired to deploy arms 50 to make measurements of wall 18. Such a mechanism may be actuated in any desired way (e.g. in response to a telemetry signal from surface equipment, specific conditions or patterns of flow and/or drill string rotation, etc.).

In some embodiments the mechanism for managing arms 50 is operable to retract arms 50 into recesses 38 after arms 50 have been deployed. The mechanism for managing arms 50 may take various forms which may include actuators connected to release and/or retract arms 50. Such actuators may comprise motors, linear actuators, magnetic actuators or the like. The actuators may be powered for example, by electricity, hydraulic pressure, or pneumatic pressure and may comprise hydraulic pistons or rams for example.

In some embodiments (see FIGS. 4 to 9) tool 20 includes a magnetic mechanism for retaining arms 50 in a retracted position and selectively releasing arms 50. In this example embodiment an arm 50 is retained within a recess 38 by magnetic attraction between an arm magnet 62 supported on arm 50 near end 54 and a corresponding sleeve magnet 72. Sleeve magnet 72 is movable between an aligned or attractive position in which magnet 72 is aligned with and attracts magnet 62 and a mis-aligned or non-attractive position in which magnet 72 does not attract magnet 62 sufficiently to overcome the force applied by spring 60.

In some embodiments magnets 62 and 72 repel one another when magnet 72 is in the non-attractive position. In some embodiments a force of attraction between magnets 62 and 72 is zero or reduced significantly when magnet 72 is in the non-attractive position. Arms 50 may be released by moving magnets 72 from the attractive position to the non-attractive position.

For example, magnet 72 in the attractive position may have a first magnetic pole of a first magnetic polarity (S or N) facing toward the corresponding magnet 62 and magnet 62 may have a second magnetic pole of a second polarity (N or S) opposite to the first polarity facing toward magnet 72.

In some embodiments, the attraction between magnets 72 and 62 when magnet 72 is in in the attractive position is sufficient to draw arm 50 into recess 38. In such embodiments, arms 50 may be released by moving magnets 72 to their non-attractive positions. Subsequently, magnets 72 may be returned to their attractive positions to draw arms 50 back into recesses 38 and hold arms 50 in recesses 38.

Sleeve magnets 72 may, for example, comprise rare earth magnets such as neodymium magnets. For example sleeve magnets 72 may comprise ¾ circular neodymium magnets. In some embodiments, sleeve magnets 72 are stronger than corresponding magnets 62.

In the illustrated embodiment, sleeve magnets 72 are supported on a rotatable magnet sleeve 70. Sleeve 70 may be housed between outer casing 22 and inner sleeve 36. Where arms 50 are arranged in tiers, each tier may have a corresponding sleeve 70 that carries magnets 72 corresponding to the arms 50 of the tier.

Sleeve 70 is rotatable about a longitudinal centreline of tool 20 to move associated magnets 72 between their attractive and non-attractive positions. For example, a sleeve 70 for a tier that has four arms 50 may carry four magnets 72. Sleeve 70 may be axially aligned with the portions of cavities or recesses 38 that receive ends 54 of the arms 50 controlled by the sleeve 70.

In some embodiments, as illustrated in FIGS. 4 and 5, outer casing 22 optionally includes a magnetic transfer body 74 embedded therein at a position between arm magnets 62 and sleeve magnets 72 so as to transfer magnetic flux between the arm magnets 62 and sleeve magnets 72 when the outer casing 22 is made of a non-magnetic material.

Figure 6:
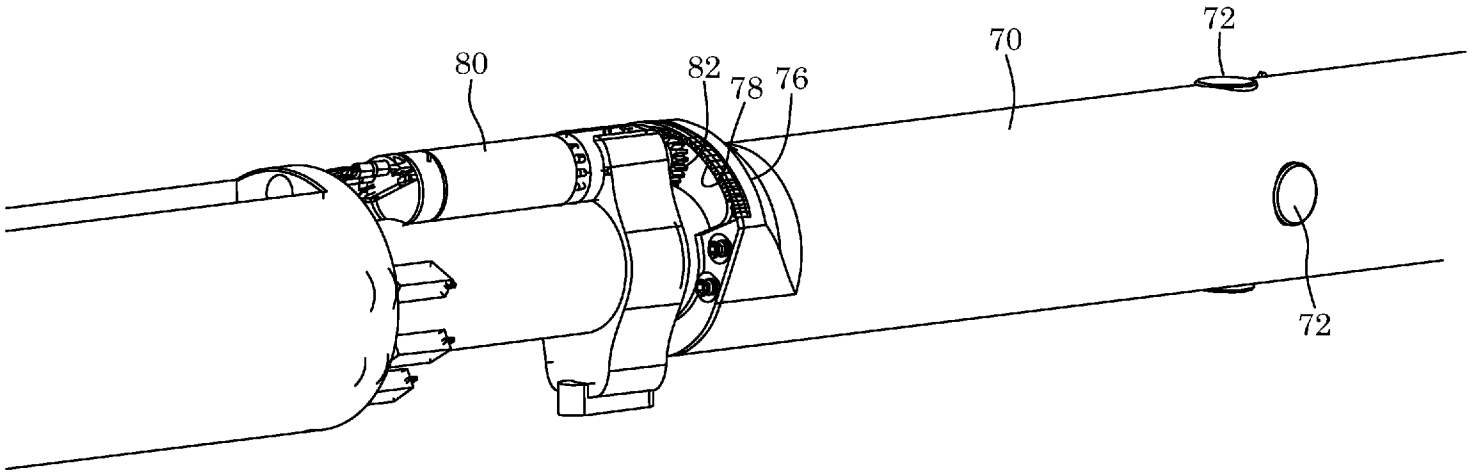
FIG. 6 is a perspective view of the apparatus of FIG. 2 with the outer casing removed.
Figure 7:
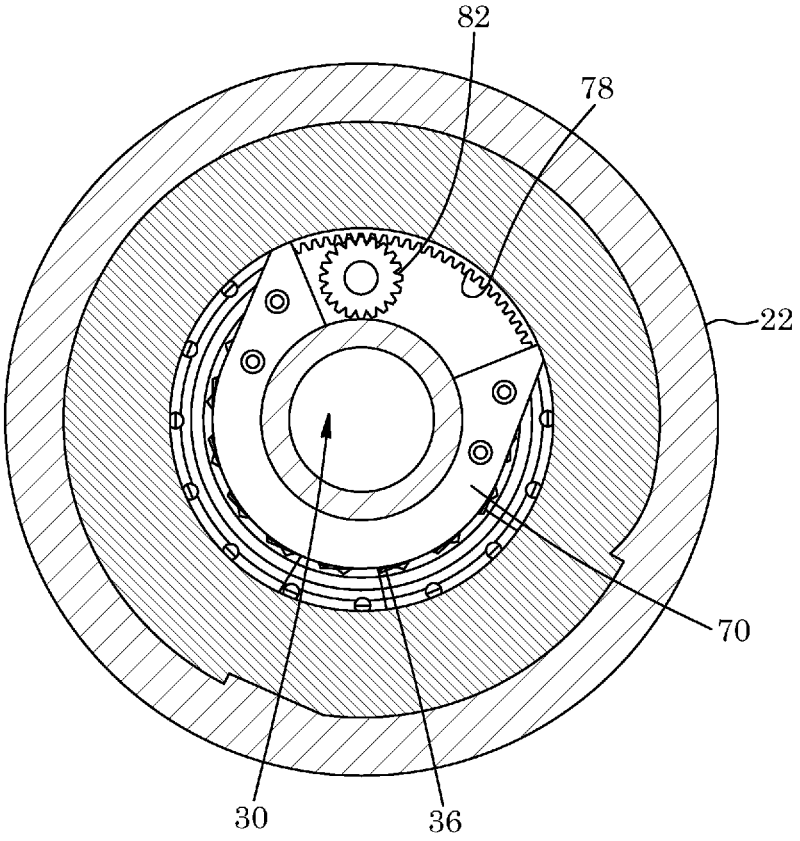
FIG. 7 is a cross sectional view of the apparatus of FIG. 2 as taken along the line 7-7 of FIG. 4.

Turning now to FIGS. 6 and 7, rotatable sleeve 70 may include an enlarged portion 76 having a plurality of gear teeth 78 therein. Outer casing 22 (not shown in FIG. 6 for clarity) encloses a motor 80 with a driven gear 82 positioned to engage gear teeth 78 of rotatable sleeve 70. Motor 80 is therefore operable to rotate rotatable sleeve 70 so as to move the carried magnets 72 between their attractive positions (aligned with corresponding magnets 62) and non-attractive positions (misaligned with corresponding magnets 62).

The illustrated magnetic mechanism may be varied. For example one of magnets 62, 72 may be replaced by a body of a ferrous metallic material. For example, magnet 62 may be omitted in a case where an arm 50 is made of a ferrous metallic material or supports a piece of ferrous metallic material in place of magnet 62. As another example, a radially outward face of sleeve 70 may include magnetic poles of different polarities arranged such that in one rotational position of sleeve 70 a magnetic pole of each magnet 62 that faces sleeve 70 is aligned adjacent to an opposite magnetic pole of sleeve 70 (such that the opposite poles attract one another) and in a second rotational position of sleeve 70 the magnetic pole of each magnet 62 that faces sleeve 70 is aligned adjacent to a same polarity magnetic pole of sleeve 70 (such that the same poles repel one another).

Figure 10:
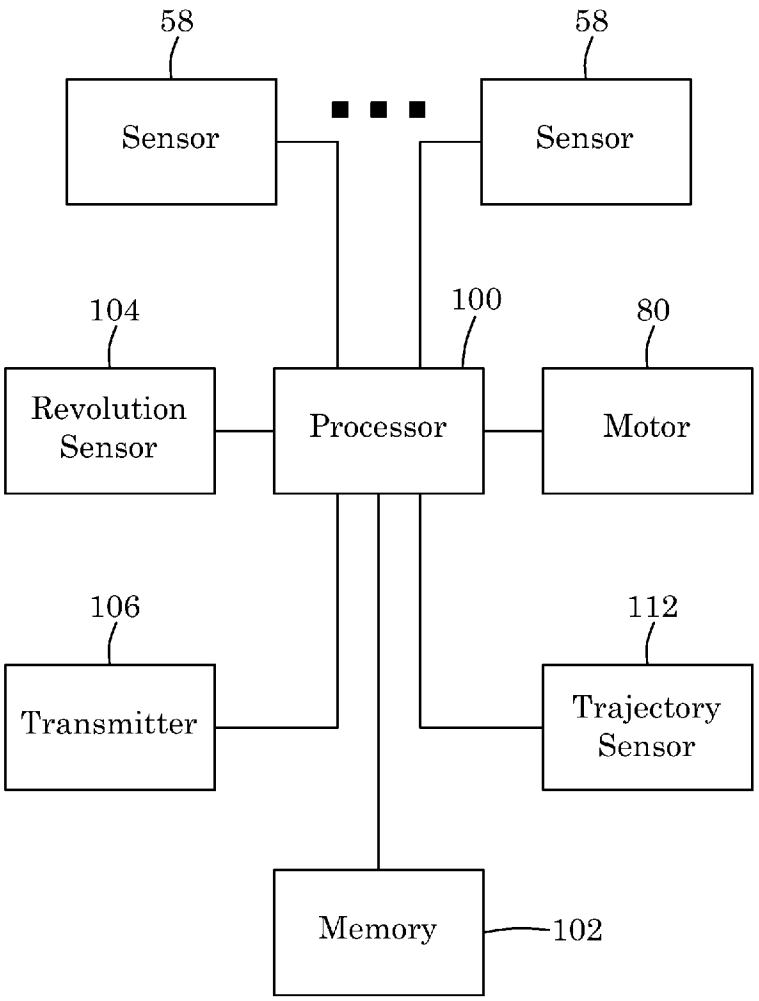
FIG. 10 is a schematic of a control system for use in the apparatus of FIG. 2.

As shown in FIG. 10, tool 20 may further include a processor 100, and memory 102 that stores machine instructions that, when executed by processor 100, cause processor 100 to perform one or more of the operations and methods described herein and/or store data collected by the sensors 59 and/or 66.

Figure 11:
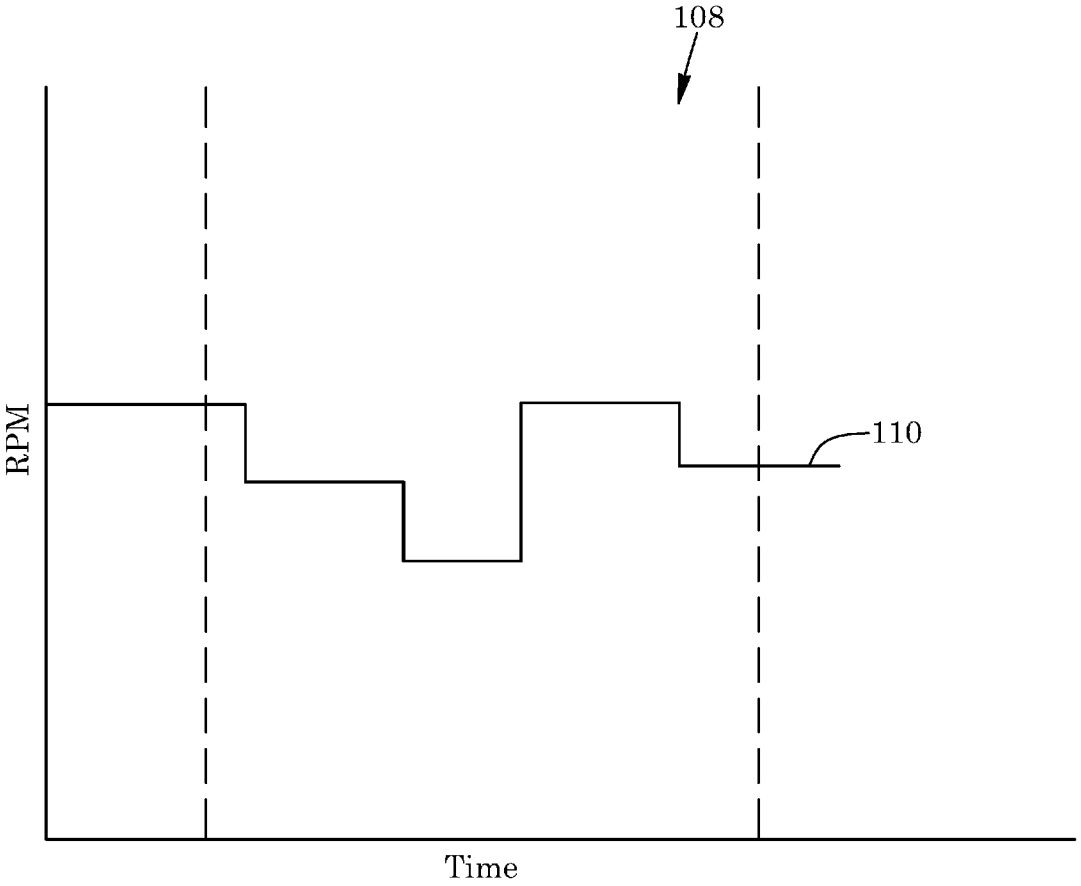
FIG. 11 is an illustration of a revolution speed pattern for use in the apparatus of FIG. 2.

In some embodiments, tool 20 includes a revolutions sensor 104 adapted to measure a speed of rotation of tool 20. In such embodiments, processor 100 may be adapted to receive an input from the revolutions sensor 104 and recognize a pre-determined pattern 108 of rotational speeds 110 (for example as illustrated in FIG. 11). When such a predetermined pattern 108 is recognized, processor 100 may cause causes motor 80 to rotate sleeve 70 to disengage sleeve magnets 72 from arm magnets 62 so as to release arms 50 to be pivoted out of recesses 38 by springs 60.

In some embodiments tool 20 includes a transmitter and/or receiver 106 as are commonly known. Transmitter/receiver 106 may be controlled to transmit signals representing the measurements obtained by revolution sensor 104 or other sensors of tool 20 to a user at the surface. In such embodiments transmitter/receiver 106 may optionally receive commands from surface equipment that are recognized by processor 100 and which cause processor 100 to rotate sleeves 70 as described above.

Some embodiments include one or more of a vibration sensor or fluid flow rate sensor located in outer casing 22. Such sensors may be operable to measure the vibrations induced by flow of fluid through outer casing 22. The vibration or flow rates may be measured and compared to a pattern similar to that illustrated in FIG. 11 and described above.

Furthermore, optionally, tool 20 may include a trajectory sensor 112 adapted to measure the wellbore inclination, roll angle and potentially azimuth of the tool 20. It will be appreciated that such a trajectory sensor 112 may enable processor 100 to locate the radial measurement around the tool 20 as well as to coordinate data obtained by the tool 20 with other data regarding the wellbore 10 and surrounding geology.

More generally, in this specification, the term "processor" is intended to broadly encompass any type of device or combination of devices capable of performing the functions described herein, including (without limitation) other types of microprocessors, microcontrollers, other integrated circuits, other types of circuits or combinations of circuits, logic gates or gate arrays, or programmable devices of any sort, for example, either alone or in combination with other such devices located at the same location or remotely from each other. Additional types of processor(s) will be apparent to those ordinarily skilled in the art upon review of this specification, and substitution of any such other types of processor(s) is considered not to depart from the scope of the present invention as defined herein. In various embodiments, processor 100 is implemented as a single-chip, multiple chips and/or other electrical components including one or more integrated circuits and printed circuit boards.

Computer code comprising instructions for processor(s) 100 to carry out the various embodiments, aspects, features, etc. of the present disclosure may reside in memory 102. The code may be broken into separate routines, products, etc. to carry forth specific steps disclosed herein. Processor 100 together with a suitable operating system may operate to execute instructions in the form of computer code and produce and use data. By way of example and not by way of limitation, the operating system may be Windows-based, Mac-based, or Unix or Linux-based, among other suitable operating systems. Operating systems are generally well known and will not be described in further detail here.

Memory 102 may include various tangible, non-transitory computer-readable media including Read-Only Memory (ROM) and/or Random-Access Memory (RAM). As is well known in the art, ROM acts to transfer data and instructions uni-directionally to processor 100, and RAM is used typically to transfer data and instructions in a bi-directional manner. In the various embodiments disclosed herein, RAM includes computer program instructions that when executed by processor 100 cause processor 100 to execute the program instructions described in greater detail herein. More generally, the term "memory" as used herein encompasses one or more storage mediums and generally provides a place to store computer code (e.g., software and/or firmware) and data. It may comprise, for example, electronic, optical, magnetic, or any other storage or transmission device capable of providing the processor 100 with program instructions. Memory 102 may further include a floppy disk, CD-ROM, DVD, magnetic disk, memory chip, ASIC, FPGA, EEPROM, EPROM, flash memory, optical media, or any other suitable memory from which processor 100 can read instructions.

Figure 8:
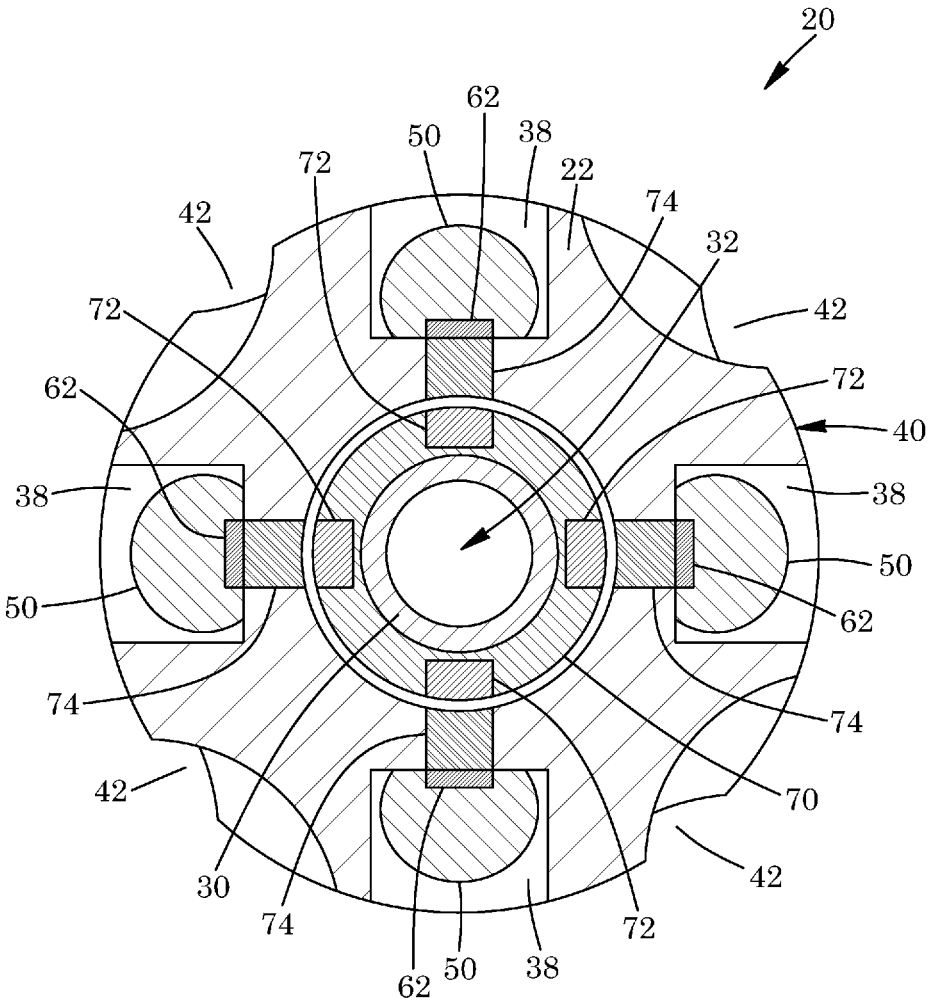
FIG. 8 is a cross sectional view of the apparatus of FIG. 2 as taken along the line 8-8 of FIG. 4 at a first or retracted position.
Figure 9:
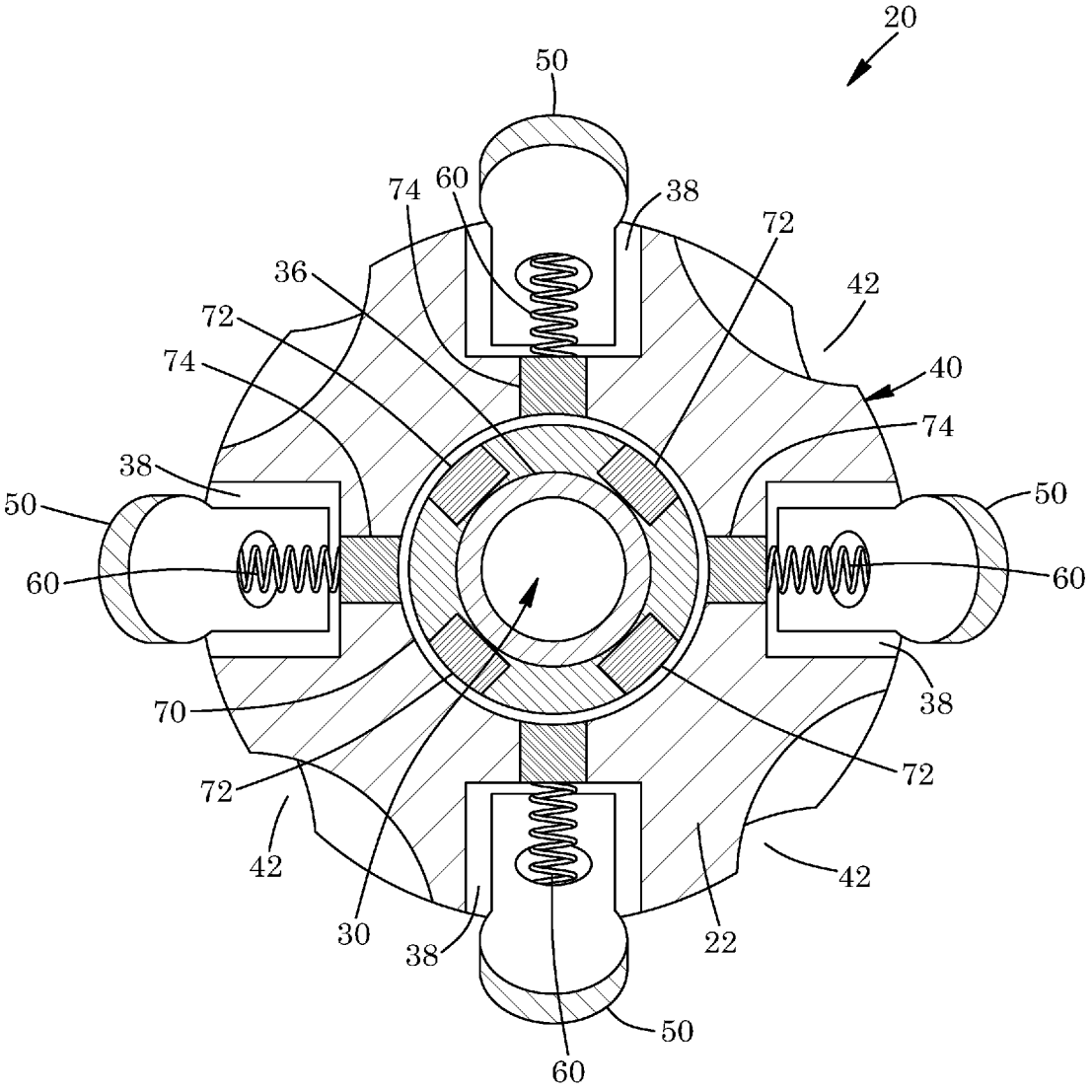
FIG. 9 is a cross sectional view of the apparatus of FIG. 2 as taken along the line 8-8 of FIG. 4 at a second or extended position.

In operation the tool 20 may be located within a drill string 16 and the drilling operation performed as is commonly known. In this initial position, sleeve magnets 72 are aligned with arm magnets 62 so as to retain arms 50 within recesses 38 as illustrated in FIGS. 4 and 8. When an operator desires to activate tool 20, the operator may cause the drill string 16 to be rotated at the pre-determined pattern 108 which is detected by the revolution sensor 104 and recognized by processor 100. Processor 100, in turn, causes motor 80 to rotate sleeve 70 so as to misalign sleeve magnets 72 from the corresponding arm magnets 62 thereby permitting springs 60 to bias arms 50 out from recesses 38 as illustrated in FIGS. 5 and 9.

Drill string 16 may then be drawn out of wellbore 10 thereby recording the desired measurements with position sensors 66 and/or sensors 59. Processor 100 may also be programmed to cause motor 80 to rotate sleeve 70 such that sleeve magnets 72 are re-aligned with the corresponding arm magnets 62 thereby drawing arms 50 back into recesses 38. Such withdrawing of the arms 50 may be performed, for example, after a time delay or a recognition of a further pre-determined rotational pattern 108.

The outer casing 22 may be fabricated using any suitable material as are commonly known including metals, composites by way of non-limiting example, using any common forming methods, such as casting, moulding, or machining, by way of non-limiting example. It will be appreciated that all components of the present device will be required to be formed of materials and in sufficient thicknesses and dimensions to withstand the torque stress, pressure, temperature and anticorrosive standards of bottom hole assemblies as are commonly known.

In some embodiments, short range wireless communication (e.g. Bluetooth transmission) is used to transfer measurements of wellbore 10 from tool 20. In such embodiments, once tool 20 is at the surface of ground 8, a surface station computer will send a prompt to tool 20 to download the data gathered. In some embodiments, tool 20 includes a high pressure port. In such embodiments, when tool 20 is at the surface of ground 8, an electrical data connector (e.g. a USB connector) may be inserted into the high pressure port. In such embodiments, data from wellbore 10 may be downloaded to surface equipment or a USB memory stick or the like.

Interpretation of Terms

Unless the context clearly requires otherwise, throughout the description and the 1. "comprise", "comprising", and the like are to be construed in an inclusive sense, as opposed to an exclusive or exhaustive sense; that is to say, in the sense of "including, but not limited to";
2. "connected", "coupled", or any variant thereof, means any connection or coupling, either direct or indirect, between two or more elements; the coupling or connection between the elements can be physical, logical, or a combination thereof;
3. "herein", "above", "below", and words of similar import, when used to describe this specification, shall refer to this specification as a whole, and not to any particular portions of this specification;
4. "or", in reference to a list of two or more items, covers all of the following interpretations of the word: any of the items in the list, all of the items in the list, and any combination of the items in the list;
5. the singular forms "a", "an", and "the" also include the meaning of any appropriate plural forms.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Electronics in various embodiments of the invention may be implemented using specifically designed hardware, configurable hardware, programmable data processors configured by the provision of software (which may optionally comprise "firmware") capable of executing on the data processors, special purpose computers or data processors that are specifically programmed, configured, or constructed to perform one or more steps in a method as explained in detail herein and/or combinations of two or more of these. Examples of specifically designed hardware are: logic circuits, application-specific integrated circuits ("ASICs"), large scale integrated circuits ("LSIs"), very large scale integrated circuits ("VLSIs"), and the like. Examples of configurable hardware are: one or more programmable logic devices such as programmable array logic ("PALs"), programmable logic arrays ("PLAs"), and field programmable gate arrays ("FPGAs"). Examples of programmable data processors are: microprocessors, digital signal processors ("DSPs"), embedded processors, graphics processors, math co-processors, general purpose computers, server computers, cloud computers, mainframe computers, computer workstations, and the like. For example, one or more data processors in a control circuit for a tool 20 may implement methods as described herein by executing software instructions in a program memory accessible to the processors.

Where a component (e.g. a sensor, actuator, firmware, processor, assembly, device, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

Various features are described herein as being present in "some embodiments". Such features are not mandatory and may not be present in all embodiments. Embodiments of the invention may include zero, any one or any combination of two or more of such features. This is limited only to the extent that certain ones of such features are incompatible with other ones of such features in the sense that it would be impossible for a person of ordinary skill in the art to construct a practical embodiment that combines such incompatible features. Consequently, the description that "some embodiments" possess feature A and "some embodiments" possess feature B should be interpreted as an express indication that the inventors also contemplate embodiments which combine features A and B (unless the description states otherwise or features A and B are fundamentally incompatible).

ADDITIONAL DESCRIPTION

Examples of a method and apparatus for measuring a wellbore have been described. The following clauses are offered as further description.

(1) Apparatus for measuring the profile of a wellbore, the apparatus comprising: a cylindrical body having first and second ends threaded for connection in line with a drill string and a passage extending through the body between the first and second ends; a plurality of arms pivotally coupled on an outer surface of the cylindrical body, each of the arms biased to pivot so as to move a free end thereof radially away from the outer surface of the body, the plurality of arms angularly spaced apart around the cylindrical body and arranged in a plurality of tiers, each of the tiers comprising three or more of the arms, the tiers being spaced apart axially from one another along the cylindrical body; sensors operable to directly or indirectly measure radial extension of each of the arms from the cylindrical body; and a holding mechanism operable to hold the arms in a retracted configuration and to selectively release the arms to pivot away from the cylindrical body.

(2) An apparatus according to clause 1, or any preceding or subsequent clause, wherein the arms of each of the tiers are equally angularly spaced apart around the cylindrical body.

(3) An apparatus according to clause 1 or 2, or any preceding or subsequent clause, wherein each of the tiers comprises 3 to 8 of the arms.

(4) An apparatus according to any of clause 1 to 3, or any preceding or subsequent clause, wherein the arms of each of the plurality of tiers are angularly offset relative to the arms of other ones of the plurality of tiers.

(5) An apparatus according to clause 4, or any preceding or subsequent clause, wherein the angular offsets between any pair of the tiers is substantially equal to 360 degrees divided by a total number of the arms in the plurality of tiers or a multiple thereof.

(6) An apparatus according to any of clauses 1 to 5, or any preceding or subsequent clause, wherein each of the tiers comprises four or more of the arms.

(7) An apparatus according to clause 6, or any preceding or subsequent clause, wherein the arms of each of the tiers are angularly spaced apart at 90 degree intervals around the cylindrical body.

(8) An apparatus according to any preceding or subsequent clause, wherein the sensors comprise magnetic sensors arranged to detect magnetic fields from magnets carried by the arms and to output signals indicative of pivot angles of the arms.

(9) An apparatus according to clause 8, or any preceding or subsequent clause, wherein the sensors comprise triaxial magnetic sensors.

(10) An apparatus according to any of clauses 1 to 9, or any preceding or subsequent clause, wherein the arms are pivotally mounted to pivot axes oriented perpendicularly to a longitudinal centreline of the cylindrical body.

(11) An apparatus according to any of clauses 1 to 9, or any preceding or subsequent clause, wherein the arms are pivotally mounted to pivot axes oriented at acute angles to a longitudinal centreline of the cylindrical body.

(12) An apparatus according to any preceding or subsequent clause, wherein the cylindrical body is formed with grooves that extend longitudinally along the body, wherein each of the grooves passes between adjacent arms of a plurality of the tiers of arms.

(13) An apparatus according to clause 12, or any preceding or subsequent clause, wherein the grooves are helical grooves.

(14) An apparatus according to clause 13, or any preceding or subsequent clause, wherein the grooves have a helix angle such that in travelling between two of the tiers the grooves travel circumferentially around the cylindrical body by an angle that is substantially equal to an angular offset of the two of the tiers.

(15) An apparatus according to clause 13 or 14, or any preceding or subsequent clause, wherein the arms are mounted to ridges that extend between adjacent ones of the grooves.

(16) An apparatus according to clause 15, or any preceding or subsequent clause, wherein centrelines of the arms are longitudinally aligned with the ridges on which the arms are mounted.

(17) An apparatus according to any preceding or subsequent clause, wherein the arms are arranged in at least three of the tiers.

(18) An apparatus according to any preceding or subsequent clause, wherein the cylindrical body is formed with recesses and each of the plurality of arms is pivotally retractable into a corresponding one of the recesses.

(19) An apparatus according to clause 18, or any preceding or subsequent clause, wherein the recesses are shaped to conform to an outer profile of the corresponding arm.

(20) An apparatus according to any preceding or subsequent clause, wherein the free ends of the arms have rounded configurations.

(21) An apparatus according to any preceding or subsequent clause, wherein the free ends of the arms comprise a wear resistant material.

(22) An apparatus according to any preceding or subsequent clause, wherein the free ends of the arms comprise a hardened button made of a wear resistant material.

(23) An apparatus according to clause 22, or any preceding or subsequent clause, wherein the wear resistant material is poly crystalline diamond.

(24) An apparatus according to clause 22 or 23, or any preceding or subsequent clause, wherein the hardened button has a diameter of 1 centimeter or less.

(25) An apparatus according to any preceding or subsequent clause, wherein the arms are mounted to the cylindrical body by pivot members that are pivotally mounted to the cylindrical body.

(26) An apparatus according to any preceding or subsequent clause, wherein some or all of the arms each include additional sensors.

(27) An apparatus according to clause 26, or any preceding or subsequent clause, wherein the additional sensors comprise one or both of temperature sensor(s) and radius proximity sensor(s).

(28) An apparatus according to any preceding or subsequent clause, wherein the arms have lengths in the range of 3 to 15 inches.

(29) An apparatus according to clause 28, or any preceding or subsequent clause, wherein the arms have lengths of 6½ inches±1½ inches.

(30) An apparatus according to any preceding or subsequent clause, wherein the holding mechanism comprises one or more of a hydraulic actuator, an electric actuator, a magnetic system and a pneumatic actuator.

(31) An apparatus according to any preceding or subsequent clause, wherein the holding mechanism comprises: a rotatable sleeve that carries a plurality of sleeve magnets that provide magnetic poles spaced apart around the magnetic sleeve, the sleeve magnets movable by rotating the sleeve between attractive positions wherein each of the arms of a tier is held in a retracted position by magnetic attraction to a corresponding one of the sleeve magnets and non-attractive positions wherein the arms are allowed to pivot away from the cylindrical body.

(32) An apparatus according to clause 31, or any preceding or subsequent clause, the apparatus comprising arm magnets on the arms, the arm magnets aligned with corresponding ones of the sleeve magnets when the sleeve magnets are in the attractive positions.

(33) An apparatus according to clause 32, or any preceding or subsequent clause, wherein the sleeve magnets are stronger than the arm magnets.

(34) An apparatus according to any of clauses 31 to 32, or any preceding or subsequent clause, wherein the sleeve magnets comprise neodymium magnets.

(35) An apparatus according to clause 34, or any preceding or subsequent clause, wherein the sleeve magnets comprise ¾ inch diameter circular neodymium magnets.

(36) An apparatus according to any of clauses 31 to 35, or any preceding or subsequent clause, the apparatus comprising a motor coupled to drive rotation of the sleeve relative to the arms.

(37) An apparatus according to any one of clauses 31 to 36, or any preceding or subsequent clause, the apparatus comprising one or more magnetic transfer bodies embedded in the cylindrical body between the sleeve magnets and the corresponding arms.

(38) An apparatus according to any preceding or subsequent clause, the apparatus comprising a data processor connected to receive output signals from the sensors and to log the output signals.

(39) An apparatus according to clause 38, or any preceding or subsequent clause, the apparatus comprising a toolface sensor wherein the processor is configured to log readings from the toolface sensor indicating an orientation and/or position of the cylindrical body.

(40) An apparatus according to clauses 38 or 39, or any preceding or subsequent clause, wherein the processor is configured by firmware to process the signals from the sensors to determine a profile of a wellbore.

(41) An apparatus according to any of clauses 38 to 40, or any preceding or subsequent clause, the apparatus comprising a revolutions sensor configured to measure a speed of rotation of the cylindrical body.

(42) An apparatus according to clause 41, or any preceding or subsequent clause, wherein the processor is configured to process a signal from the revolutions sensor, recognize a pre-determined pattern of rotational speeds and operate the holding mechanism in response to recognizing the pre-determined pattern.

(43) An apparatus according to any of clauses 38 to 42, or any preceding or subsequent clause, the apparatus comprising one or both of a vibration sensor and a fluid flow rate sensor.

(44) An apparatus according to clause 43, or any preceding or subsequent clause, wherein the processor is configured to process a signal from the vibration sensor and/or the fluid flow rate sensor, recognize a pre-determined pattern of vibration and/or fluid flow and operate the holding mechanism in response to recognizing the pre-determined pattern.

(45) An apparatus according to any one of clauses 38 to 44, or any preceding or subsequent clause, the apparatus comprising a trajectory sensor configured to measure one or more of inclination, roll angle and azimuth of the apparatus.

(46) Apparatus having any new and inventive feature, combination of features, or sub-combination of features as described herein.

(47) A method for measuring a profile of a wall of a wellbore, the method comprising: connecting apparatus according to any of the preceding clause into a drill string; lowering the drill string into the wellbore; releasing the arms and allowing the arms to pivot outwardly to contact the wall of the wellbore; and withdrawing the drill string from the wellbore while recording signals from the sensors and/or processing the signals from the sensors to determine the profile of the wall of the wellbore.

(48) Methods having any new and inventive steps, acts, combination of steps and/or acts or sub-combination of steps and/or acts as described herein.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A wellbore measuring apparatus comprising:

an outer body that is tubular and connectable in line with a drill string;

a plurality of sensors operatively coupled to and axially spaced along the outer body, the sensors being arranged in a plurality of tiers, with each said tier comprising three or more said sensors and with each said sensor being arranged to measure at least one characteristic of a wellbore; and at least one rib coupled to and extending radially outwards from the outer surface of the outer body, with the at least one rib being helical in shape and with the plurality of sensors being adjacent to the at least one rib.

2. A wellbore measuring apparatus according to claim 1, wherein the plurality of sensors extend along a path which follows that of the at least one rib.

3. A wellbore measuring apparatus according to claim 1, wherein the plurality of sensors are radially inwardly positioned relative to the at least one rib.

4. A wellbore measuring apparatus according to claim 1, wherein the outer body has a plurality of recesses, with each said sensor being positioned within a respective said recess.

5. A wellbore measuring apparatus according to claim 4, wherein the recesses extend around the outer surface of the outer body in one or more helical patterns.

6. A wellbore measuring apparatus according to claim 1, wherein the apparatus includes a processor to process signals from the plurality of sensors to determine a profile of the wellbore.

7. A wellbore measuring apparatus according to claim 6, wherein the apparatus includes a toolface sensor, with the processor logging readings from the toolface sensor indicating one or more of an orientation or position of the outer body.

8. A wellbore measuring apparatus according to claim 1, wherein the at least one rib has a helix angle such that in travelling between two of the tiers, the at least one rib travels circumferentially around the outer body by an angle that is substantially equal to an angular offset of the two of the tiers.

9. A wellbore measuring apparatus as claimed in claim 8, wherein the angular offsets of adjacent said tiers match the angular travel of the at least one rib extending therebetween.

10. A wellbore measuring apparatus according to claim 1, wherein the plurality of sensors comprise ultrasonic sensors.

11. A wellbore measuring apparatus according to claim 1, wherein the at least one rib twists around the outer surface of the outer body.

12. A wellbore measuring apparatus according to claim 1, wherein the plurality of sensors are recessed relative to the at least one rib.

13. A wellbore measuring apparatus according to claim 1, wherein the at least one rib is outwardly convex at least in part and outwardly concave at least in part.

14. A wellbore measuring apparatus comprising:

an outer body that is tubular and connectable in line with a drill string;

a plurality of sensors operatively coupled to and axially spaced along the outer body, each said sensor being arranged to measure at least one characteristic of a wellbore;

at least one rib coupled to and extending radially outwards from the outer surface of the outer body, with the at least one rib being helical in shape and with the plurality of sensors being adjacent to the at least one rib;

a revolutions sensor to measure a speed of rotation of the outer body; and a processor which processes a signal from the revolutions sensor, recognizes a pre-determined pattern of rotational speeds and activates the plurality of sensors in response to recognizing the pre-determined pattern.

15. A wellbore measuring apparatus comprising:

an outer body that is tubular and connectable in line with a drill string;

a plurality of sensors operatively coupled to and axially spaced along the outer body, each said sensor being arranged to measure at least one characteristic of a wellbore;

at least one rib coupled to and extending radially outwards from the outer surface of the outer body, with the at least one rib being helical in shape and with the plurality of sensors being adjacent to the at least one rib;

a vibration sensor to measure one or more vibrations induced by a flow of fluid through the outer body; and a processor which processes a signal from the vibration sensor, recognizes a pre-determined pattern of vibration and activates the plurality of sensors in response to recognizing the pre-determined pattern.

16. A wellbore measuring apparatus comprising:

an outer body that is tubular and connectable in line with a drill string;

a plurality of sensors operatively coupled to and axially spaced along the outer body, each said sensor being arranged to measure at least one characteristic of a wellbore;

at least one rib coupled to and extending radially outwards from the outer surface of the outer body, with the at least one rib being helical in shape and with the plurality of sensors being adjacent to the at least one rib;

a fluid flow rate sensor to measure a flow rate of flow of fluid through the outer body; and a processor which processes a signal from the fluid flow rate sensor, recognizes a pre-determined pattern of fluid flow and activates the plurality of sensors in response to recognizing the pre-determined pattern.

17. A wellbore measuring apparatus comprising:

an outer body that is tubular and connectable in line with a drill string;

a plurality of sensors operatively coupled to and axially spaced along the outer body, each said sensor being arranged to measure at least one characteristic of a wellbore; and at least one rib coupled to and extending radially outwards from the outer surface of the outer body, with the at least one rib being helical in shape and with the plurality of sensors being adjacent to the at least one rib;

a trajectory sensor to measure one or more of inclination, roll angle or azimuth of the apparatus; and a processor which locates a radial measurement around the apparatus and coordinates data obtained by the apparatus with other data regarding the wellbore and surrounding geology.

18. A wellbore measuring apparatus comprising:

an outer body that is tubular and connectable in line with a drill string;

a plurality of sensors operatively coupled to and axially spaced along the outer body, each said sensor being arranged to measure at least one characteristic of a wellbore; and at least one rib coupled to and extending radially outwards from the outer surface of the outer body, wherein the at least one rib is helical in shape, wherein the plurality of sensors are adjacent to the at least one rib, and wherein the at least one rib extends along a helical path with a helix angle dependent on a rate of rotation and speed with which the drill string is being drawn along the wellbore.

19. A wellbore measuring apparatus comprising:

an outer body that is tubular and connectable in line with a drill string;

a plurality of sensors operatively coupled to and axially spaced along the outer body, wherein each said sensor is arranged to measure at least one characteristic of a wellbore, wherein the plurality of sensors extend along a path which is helical, and wherein the path of the plurality of sensors has a helix angle dependent on a rate of rotation and speed with which the drill string is being drawn along the wellbore; and at least one rib coupled to and extending radially outwards from the outer surface of the outer body, with the at least one rib being helical in shape and with the plurality of sensors being adjacent to the at least one rib.

20. A wellbore measuring apparatus according to claim 19, wherein the plurality of sensors are radially inwardly positioned relative to the at least one rib.

* * * * *